US011161004B2

(12) United States Patent
Lee

(10) Patent No.: US 11,161,004 B2
(45) Date of Patent: Nov. 2, 2021

(54) WEIGHT TRAINING EQUIPMENT WITH ADJUSTABLE HANDLE ANGLE

(71) Applicant: Byung Don Lee, Seoul (KR)

(72) Inventor: Byung Don Lee, Seoul (KR)

( * ) Notice: Subject to any disclaimer, the term of this patent is extended or adjusted under 35 U.S.C. 154(b) by 184 days.

(21) Appl. No.: 16/614,789

(22) PCT Filed: May 24, 2018

(86) PCT No.: PCT/KR2018/005909
§ 371 (c)(1),
(2) Date: Nov. 18, 2019

(87) PCT Pub. No.: WO2018/217037
PCT Pub. Date: Nov. 29, 2018

(65) Prior Publication Data

US 2020/0197741 A1 Jun. 25, 2020

(30) Foreign Application Priority Data

May 25, 2017 (KR) ..... 10-2017-0064585

(51) Int. Cl.
*A63B 21/06* (2006.01)
*A63B 21/00* (2006.01)
(Continued)

(52) U.S. Cl.
CPC ..... *A63B 21/0617* (2015.10); *A63B 21/0058* (2013.01); *A63B 21/0728* (2013.01);
(Continued)

(58) Field of Classification Search
CPC ..... A63B 21/0053; A63B 21/0058; A63B 21/0615; A63B 21/0617; A63B 21/0728;
(Continued)

(56) References Cited

U.S. PATENT DOCUMENTS 5,498,222 A * 3/1996 Hur ..... A63B 21/055 482/112
7,678,022 B1 * 3/2010 Hsieh ..... A63B 21/0051 482/5

(Continued)

FOREIGN PATENT DOCUMENTS

CN 204319620 U 5/2015
CN 206081495 U 4/2017

(Continued)

OTHER PUBLICATIONS

International Search Report for PCT/KR2018/005909 dated Sep. 28, 2018 from Korean Intellectual Property Office.

*Primary Examiner* — Joshua Lee
(74) *Attorney, Agent, or Firm* — Revolution IP, PLLC

(57) ABSTRACT

A weight training equipment includes: a base frame that sits on the ground; a chair provided on the upper portion of the base frame and on which an exercising person may sit; first and second exercise bars that are hinge-coupled to both sides of the front of the chair and formed so as to be pushed or pulled forward and backward by the exercising person; a weight part providing weight and composed of a connection bar, which is connected to one side of the first and second exercise bars, and a weight member formed on the connection bar; and a torsion angle adjusting means for adjusting the torsion angle by rotating the first and second exercise bars.

18 Claims, 19 Drawing Sheets

(51) Int. Cl.

| | |
|---|---|
| ***A63B 22/00*** | (2006.01) |
| ***A63B 21/005*** | (2006.01) |
| ***A63B 21/072*** | (2006.01) |
| ***A63B 24/00*** | (2006.01) |
| *A63B 71/06* | (2006.01) |

(52) U.S. Cl.
CPC ..... *A63B 21/4035* (2015.10); *A63B 22/0005* (2015.10); *A63B 24/0087* (2013.01); *A63B 2071/0658* (2013.01); *A63B 2220/24* (2013.01); *A63B 2225/09* (2013.01)

(58) Field of Classification Search
CPC ..... A63B 21/075; A63B 21/4035; A63B 21/4047; A63B 22/0005; A63B 23/03508; A63B 23/1263; A63B 24/0087; A63B 71/0622; A63B 2071/0658; A63B 2220/16; A63B 2220/24; A63B 2225/09
See application file for complete search history.

(56) References Cited

U.S. PATENT DOCUMENTS

| | | | | |
|---|---|---|---|---|
| 7,862,484 | B1 | 1/2011 | Coffey | |
| 8,562,496 | B2 * | 10/2013 | Webber | A63B 23/0488 482/133 |
| 9,079,064 | B2 * | 7/2015 | Hur | A63B 21/00065 |
| 2003/0092540 | A1 * | 5/2003 | Gillen | A63B 21/0628 482/99 |
| 2017/0361166 | A1 | 12/2017 | Hong et al. | |

FOREIGN PATENT DOCUMENTS

| | | | |
|---|---|---|---|
| KR | 10-2003-0091615 | A | 12/2003 |
| KR | 10-2010-0128466 | A | 12/2010 |
| KR | 10-1066422 | B1 | 9/2011 |
| KR | 10-1361368 | B1 | 2/2014 |
| KR | 10-2016-0085079 | A | 7/2016 |

* cited by examiner

[FIG. 1]
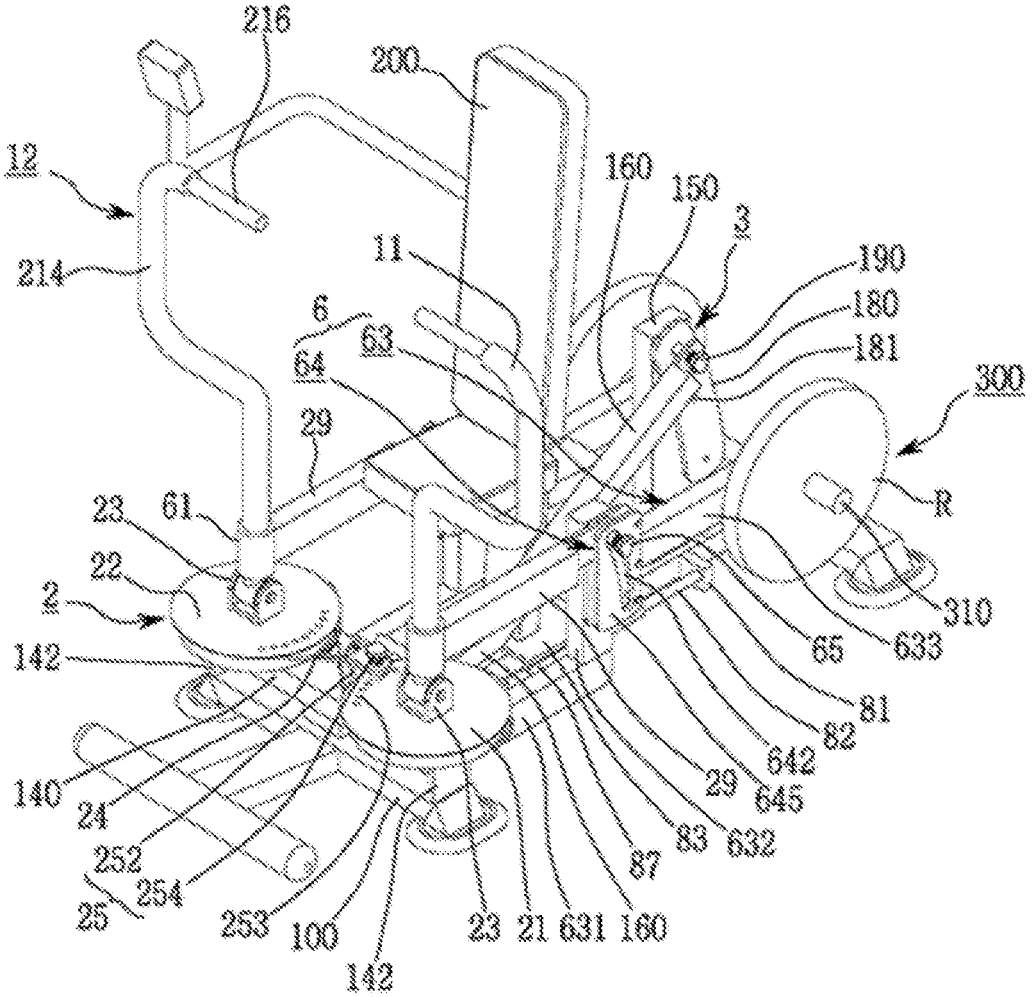

[FIG. 2]
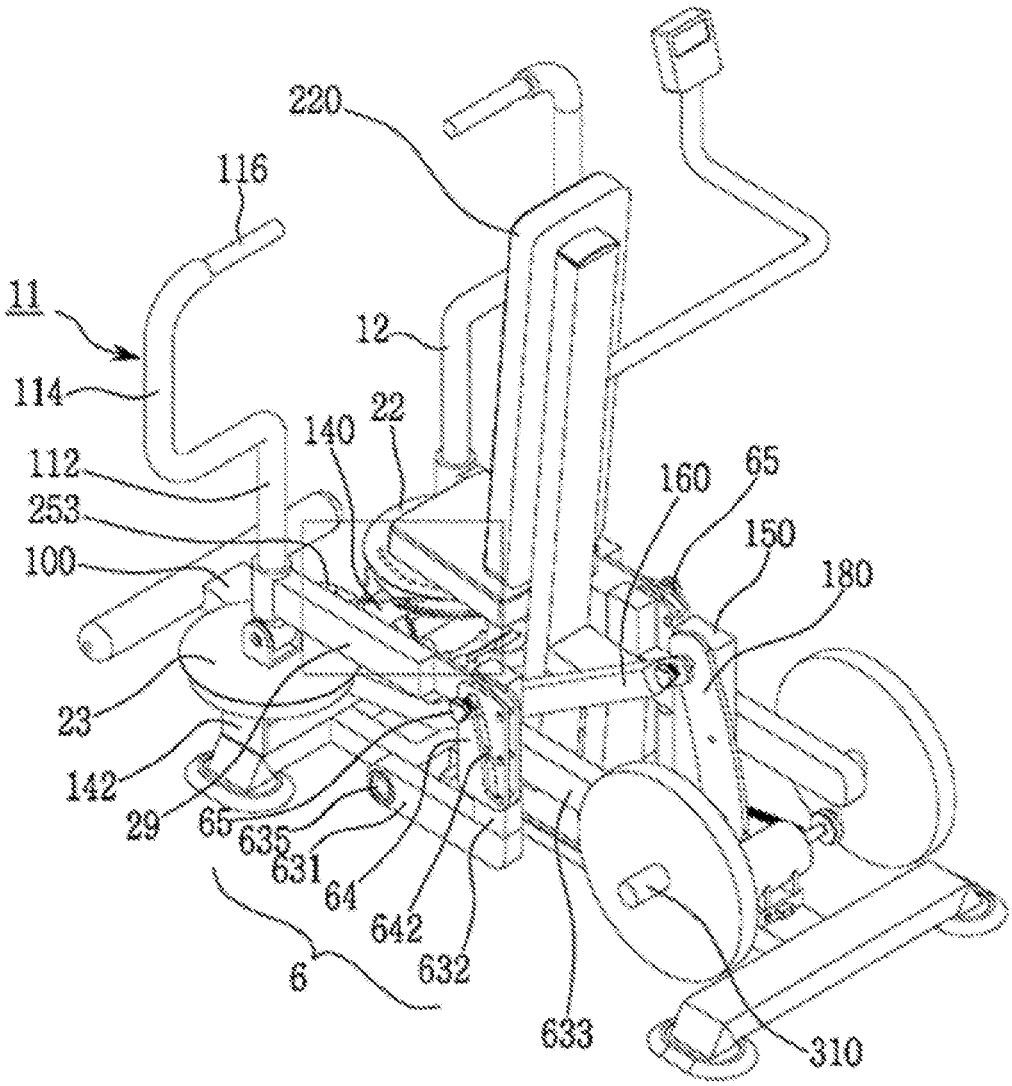

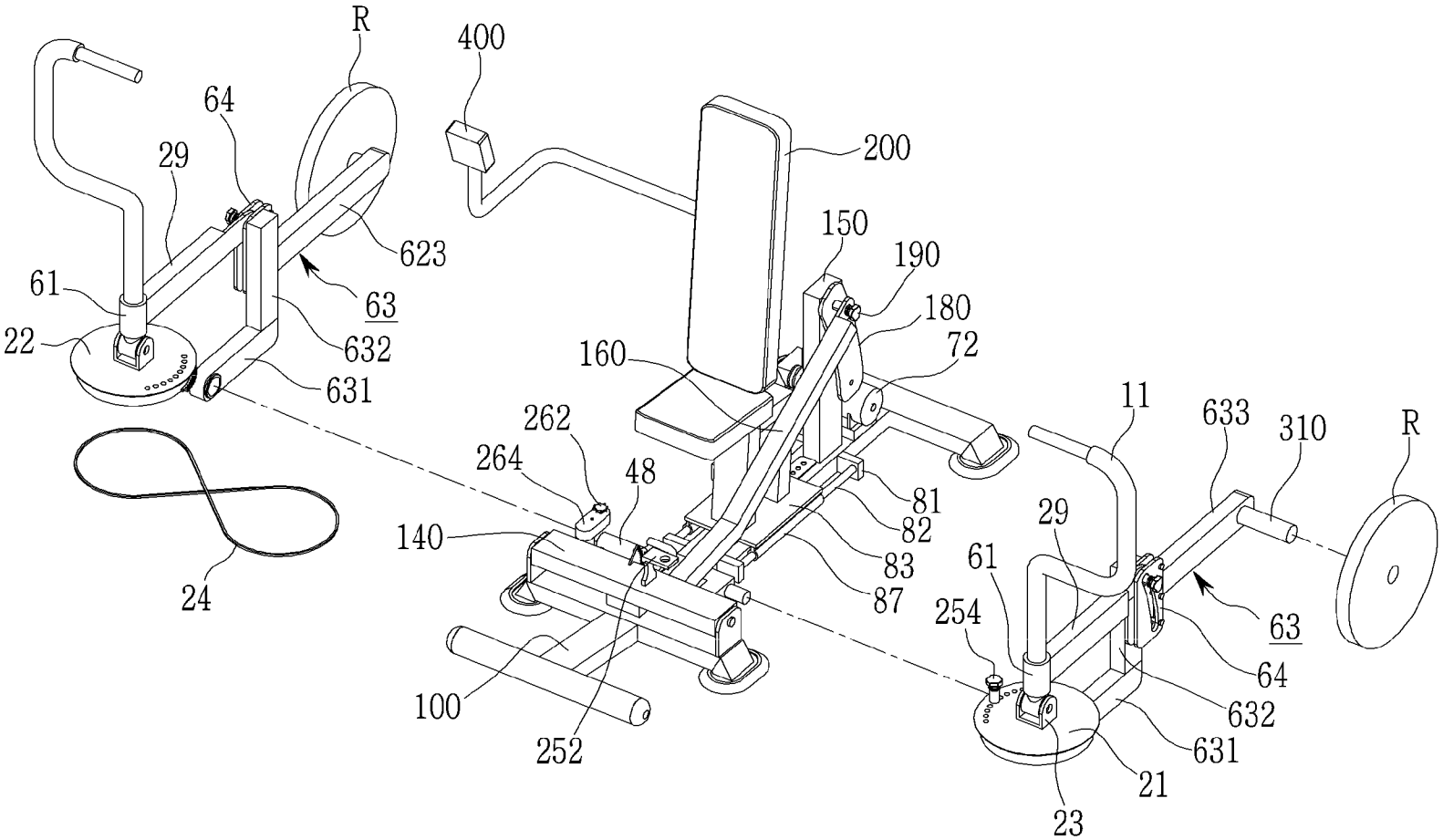
[FIG. 3]

[FIG. 4]
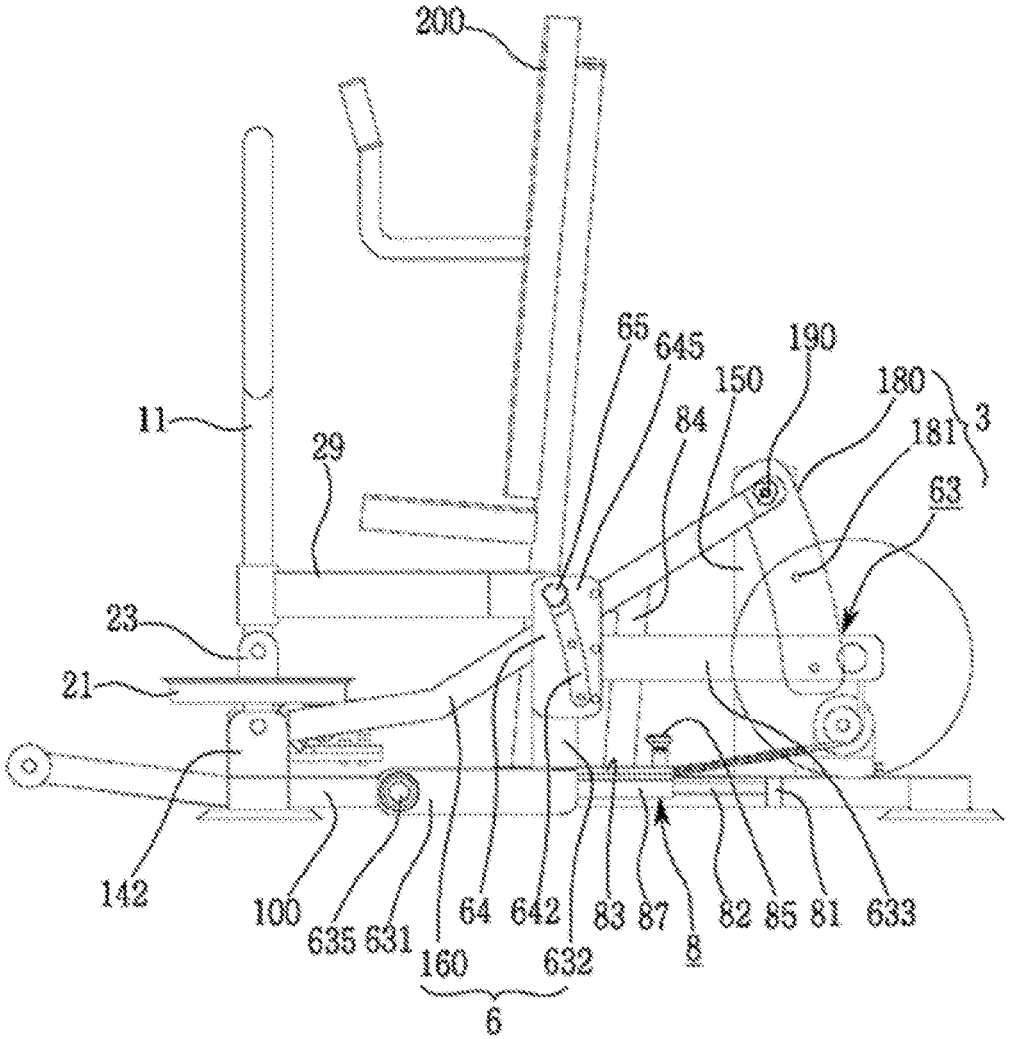

[FIG. 5]
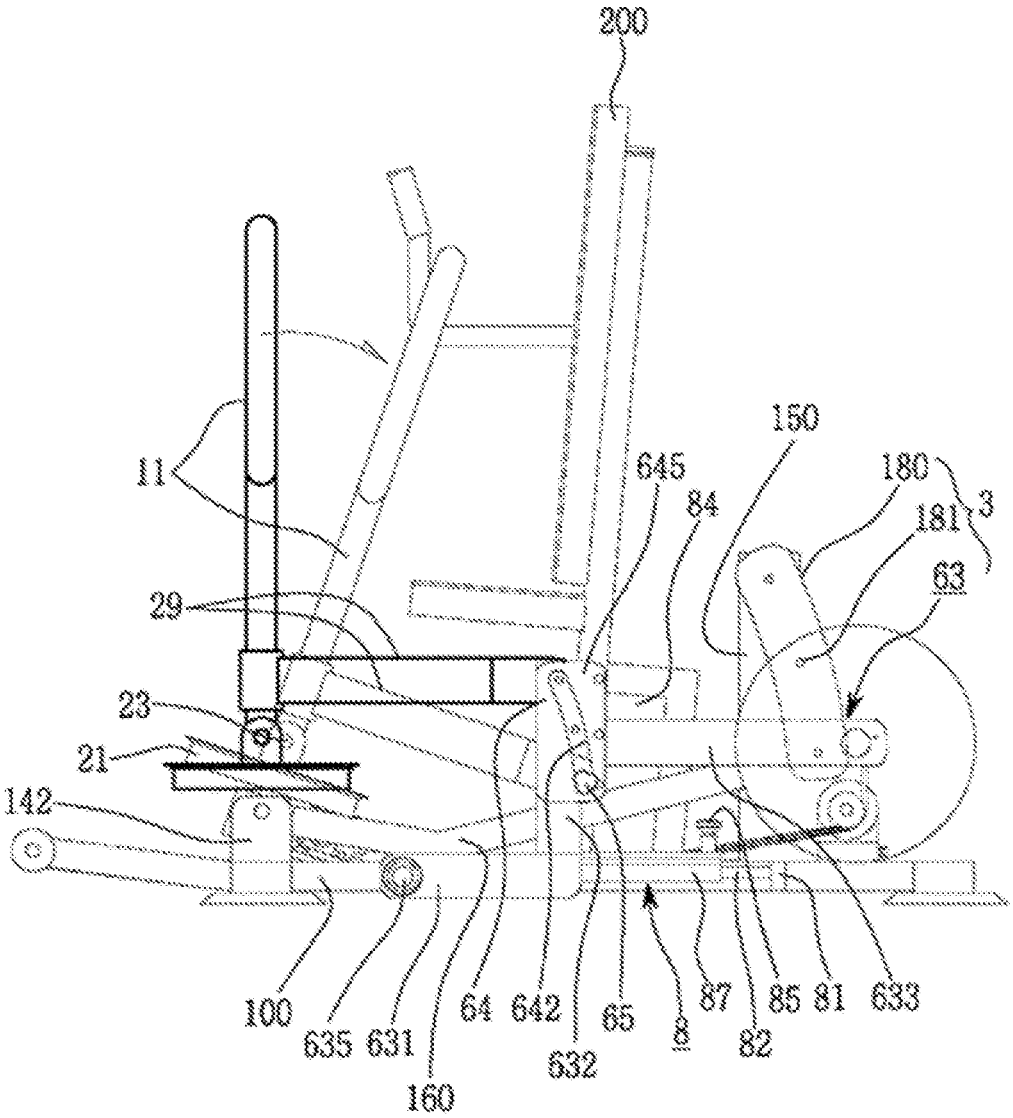

[FIG. 6]
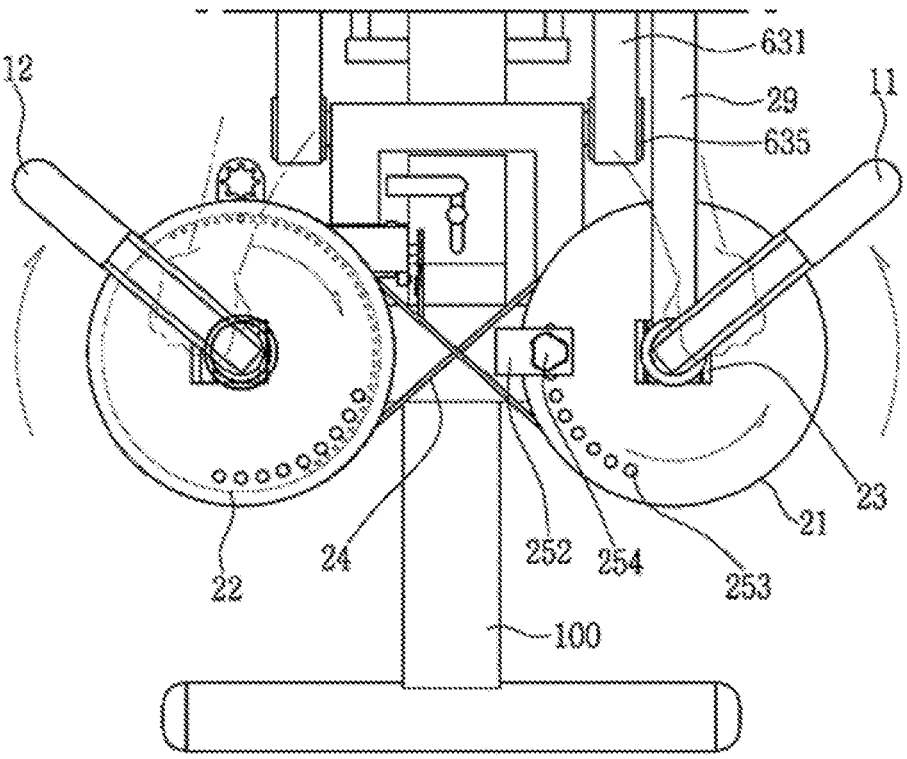
[FIG. 7]
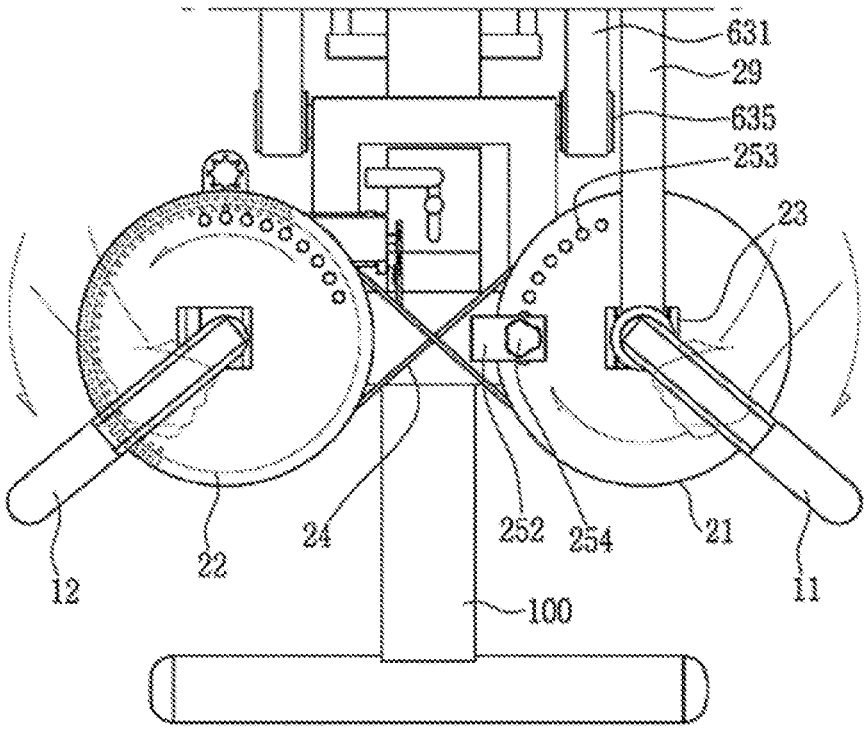

[FIG. 8]
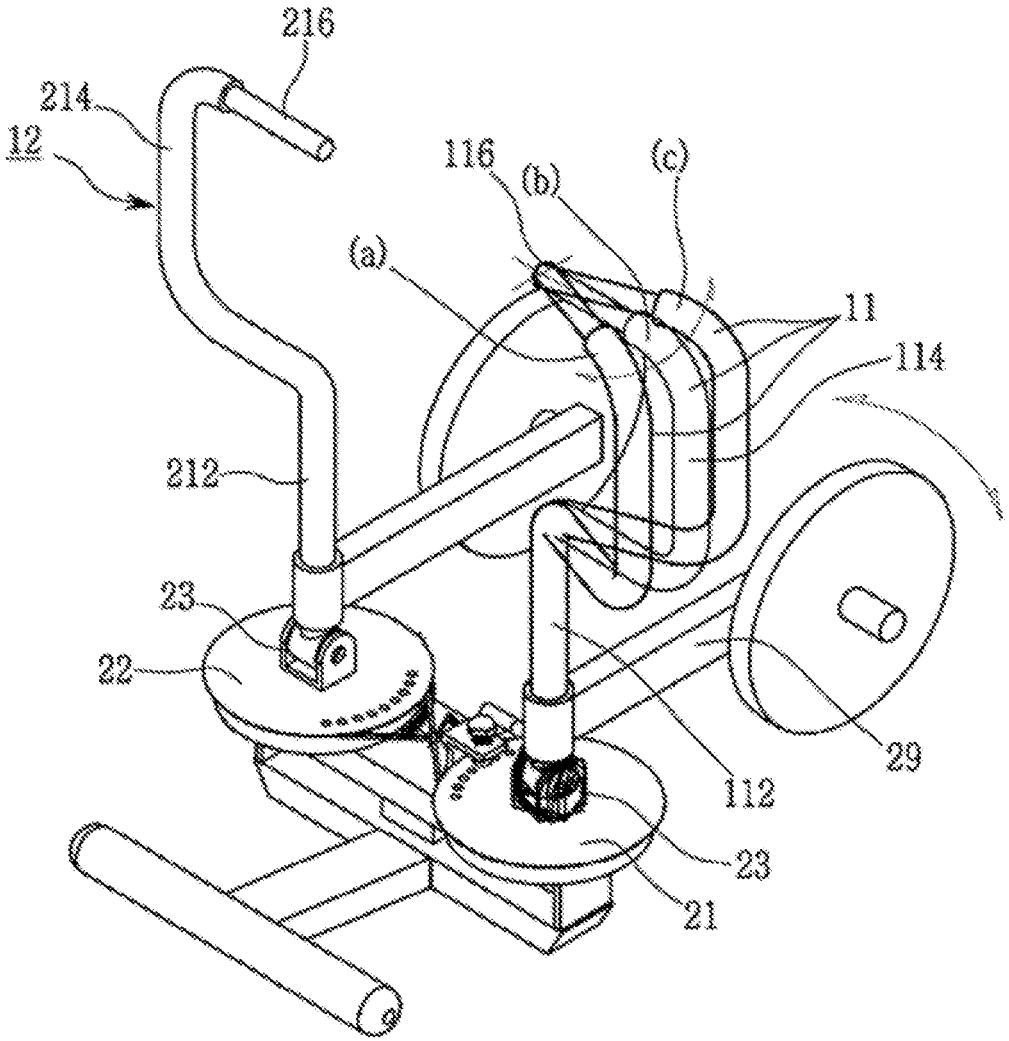

[FIG. 9]
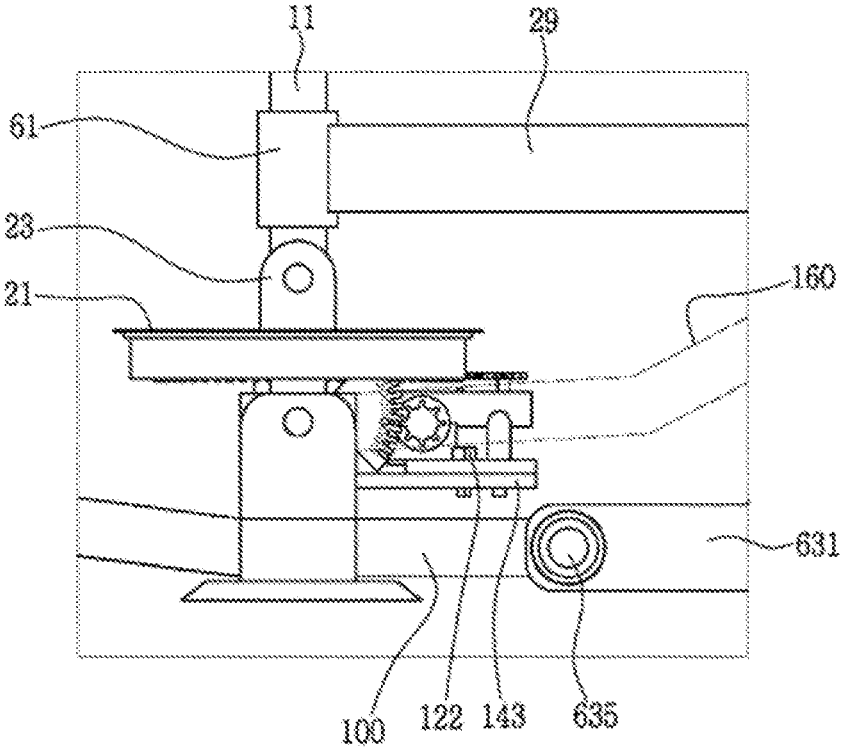
[FIG. 10]
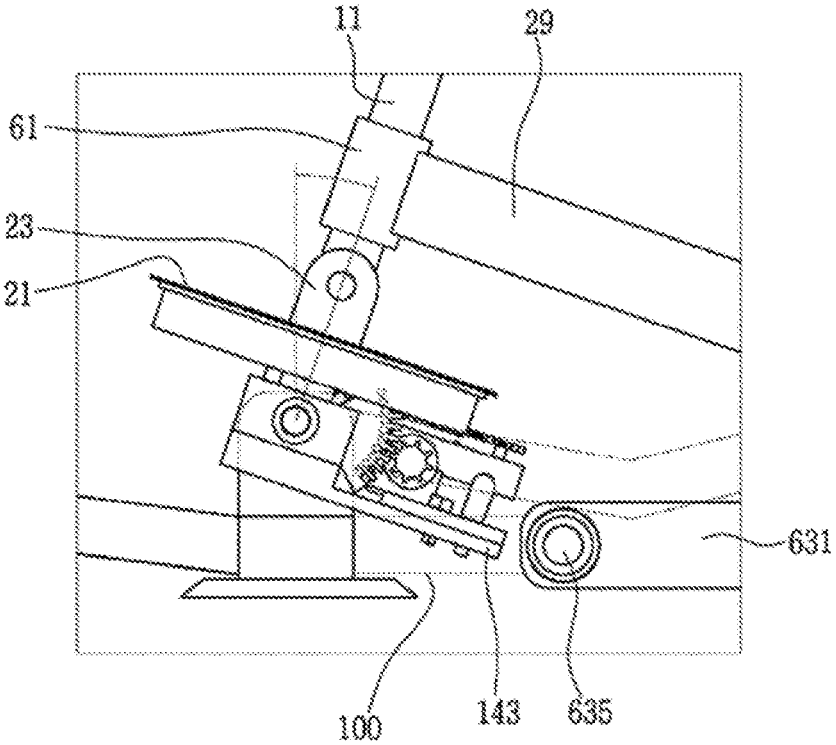

[FIG. 11]
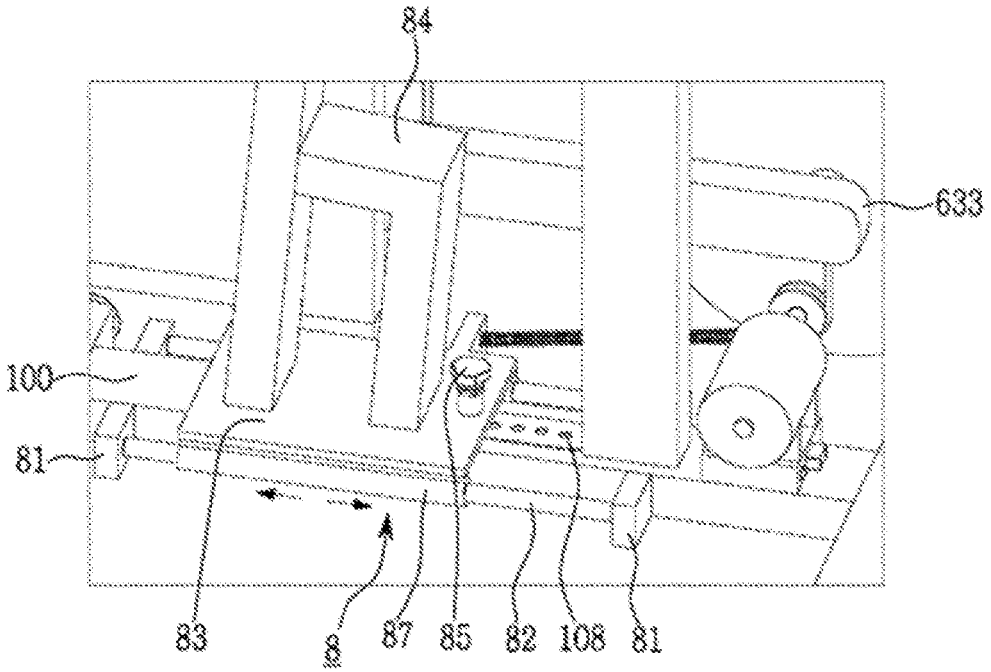
[FIG. 12]
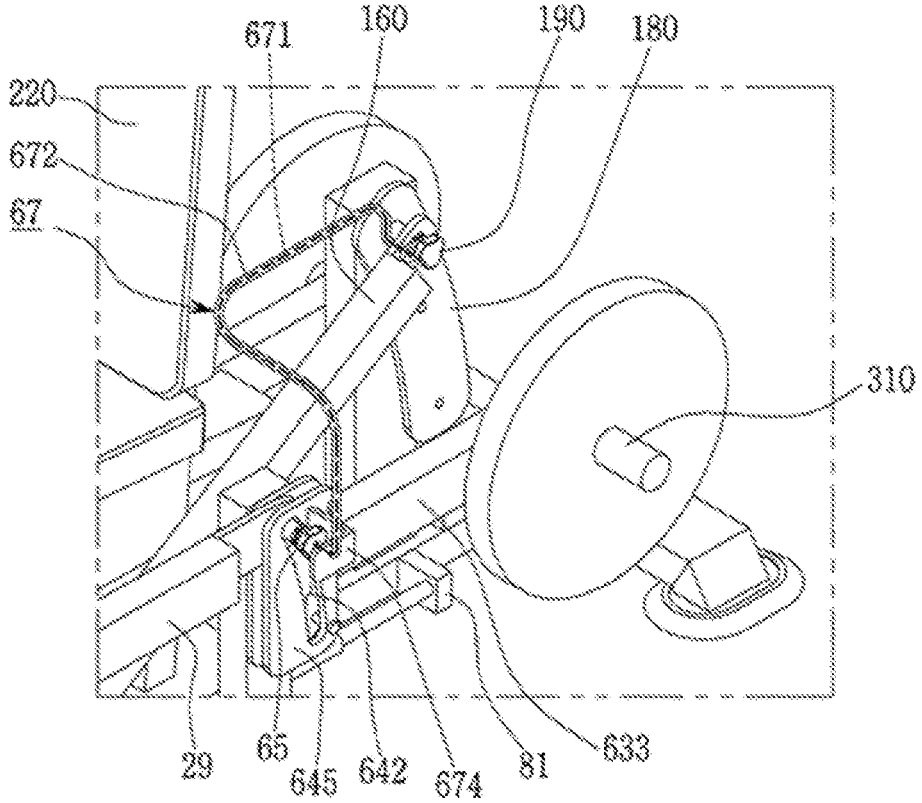

[FIG. 13]
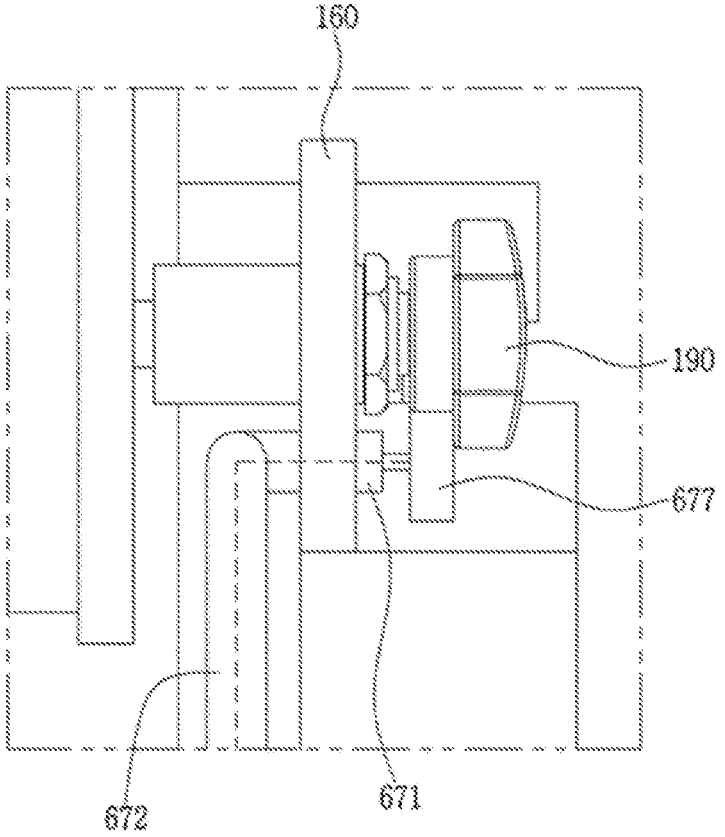
[FIG. 14]
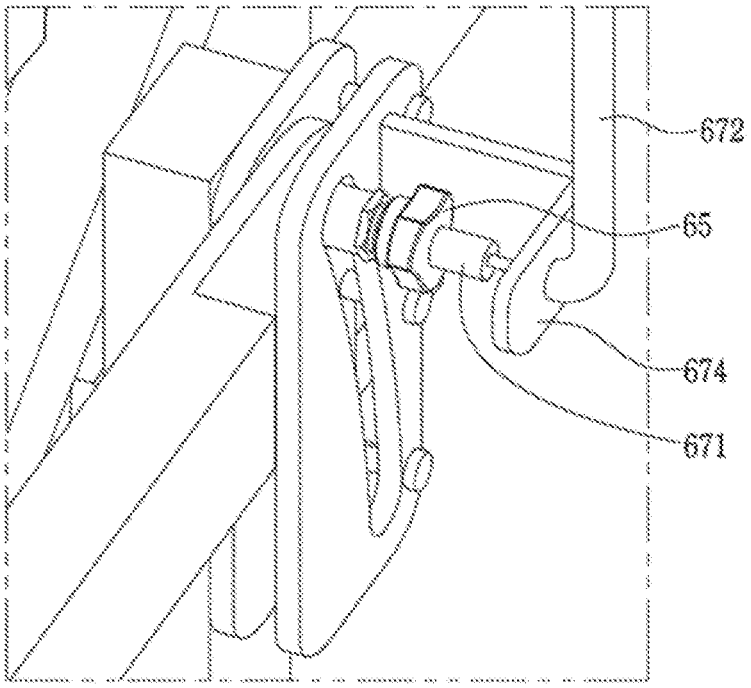

[FIG. 15]
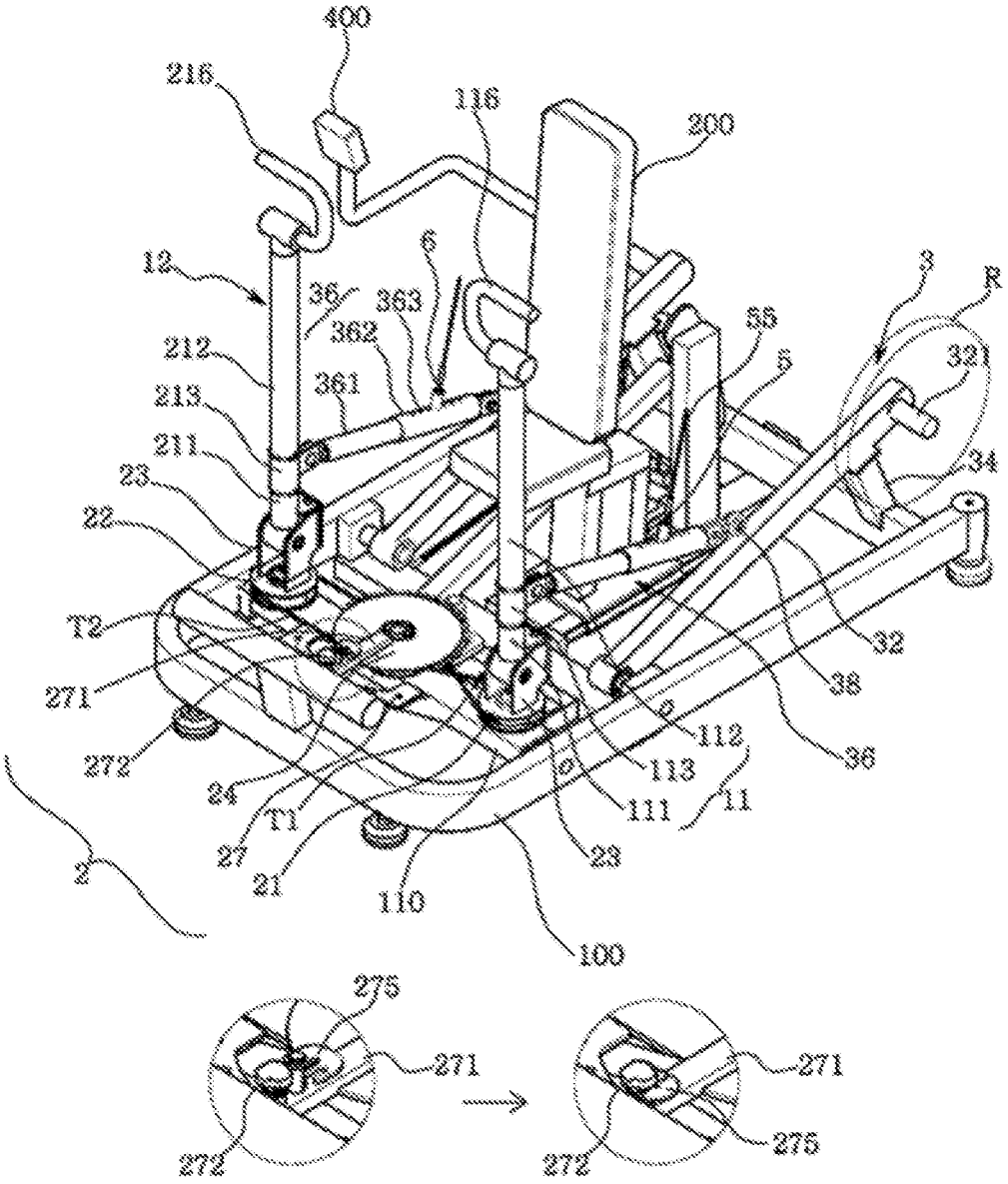

[FIG. 16]
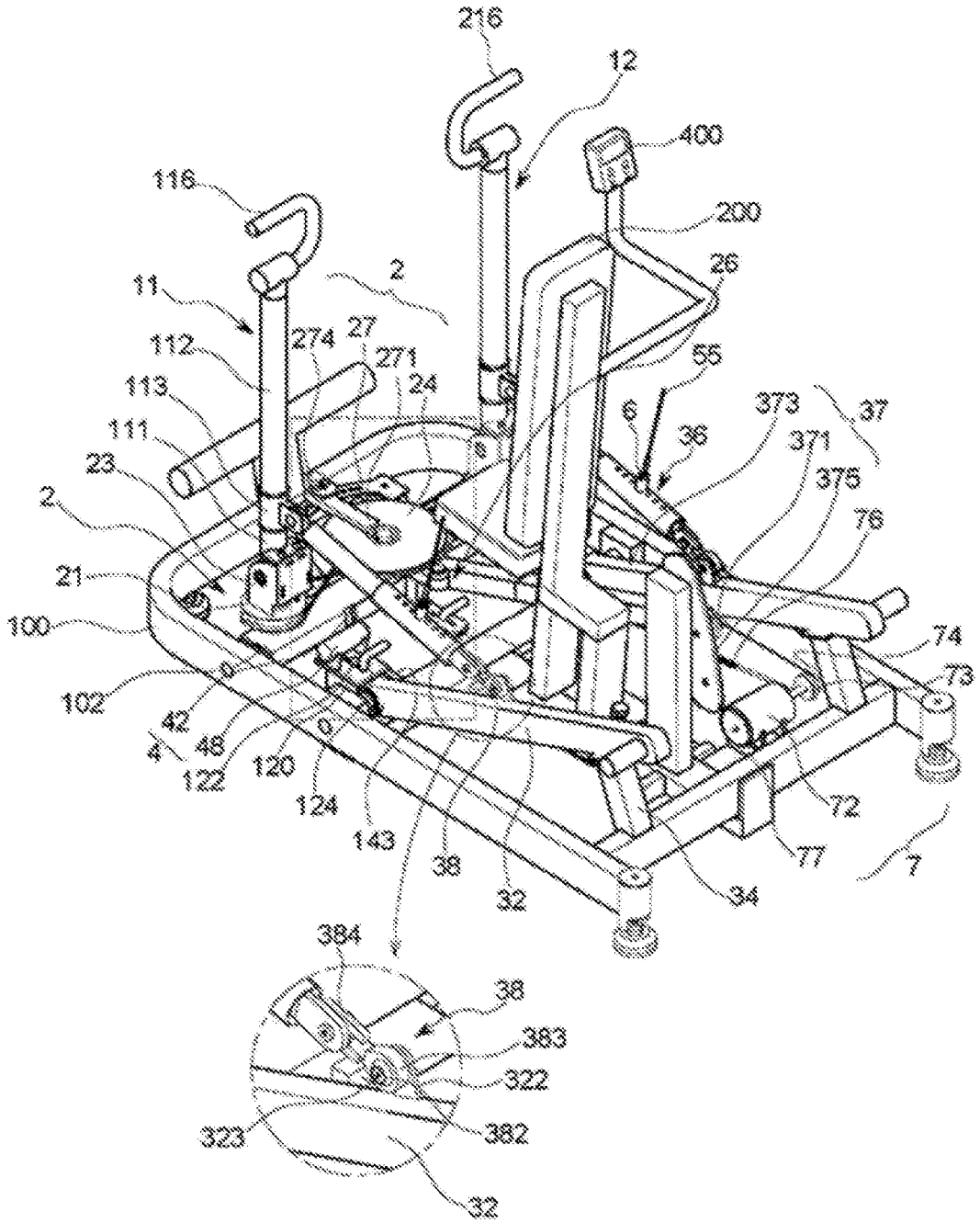

[FIG. 17]
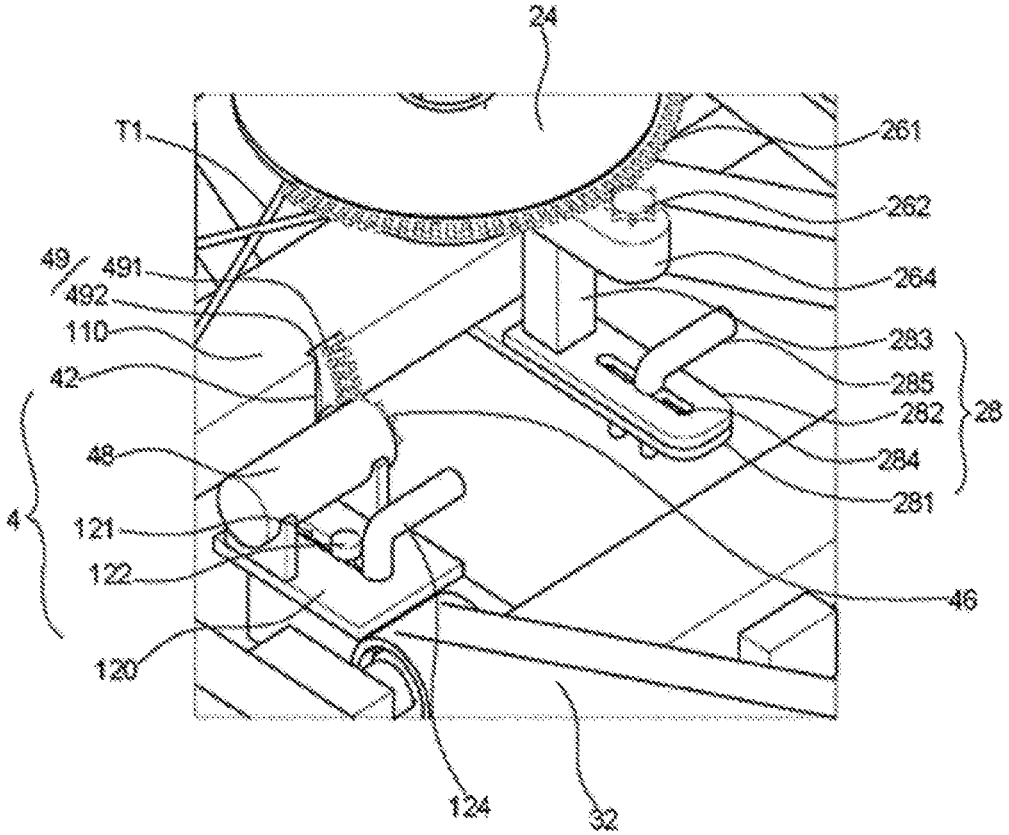

[FIG. 18]
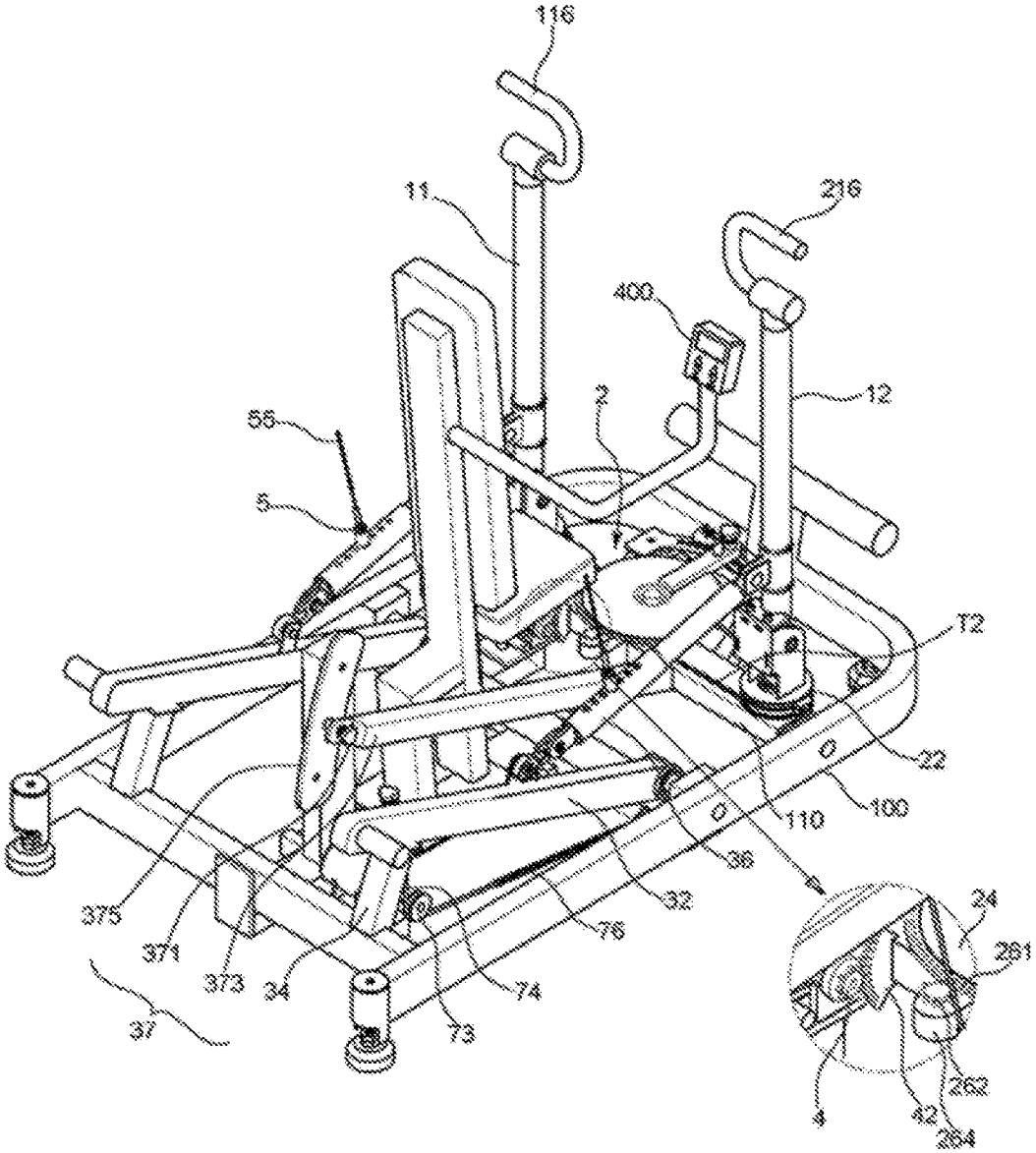

[FIG. 19]
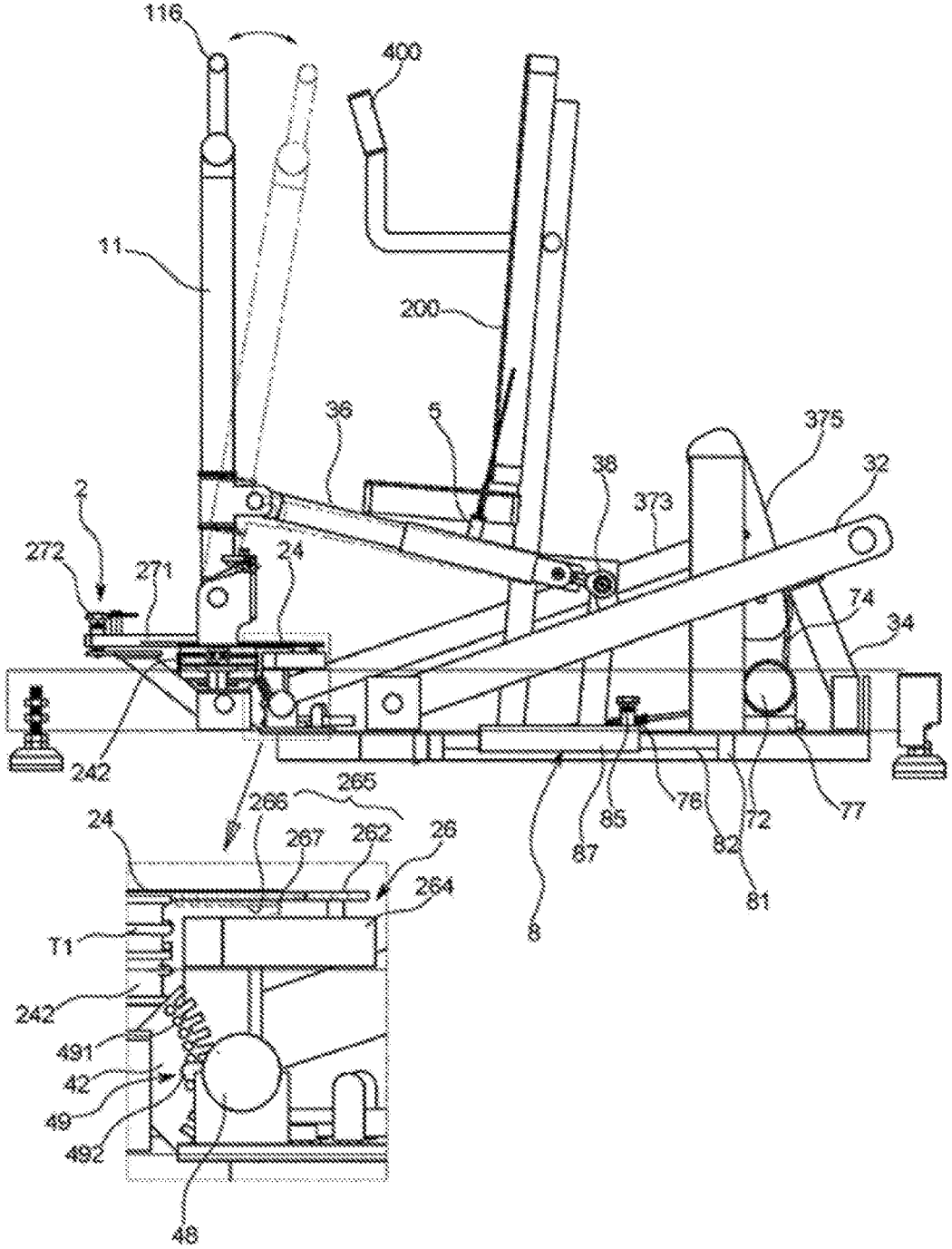

[FIG. 20]
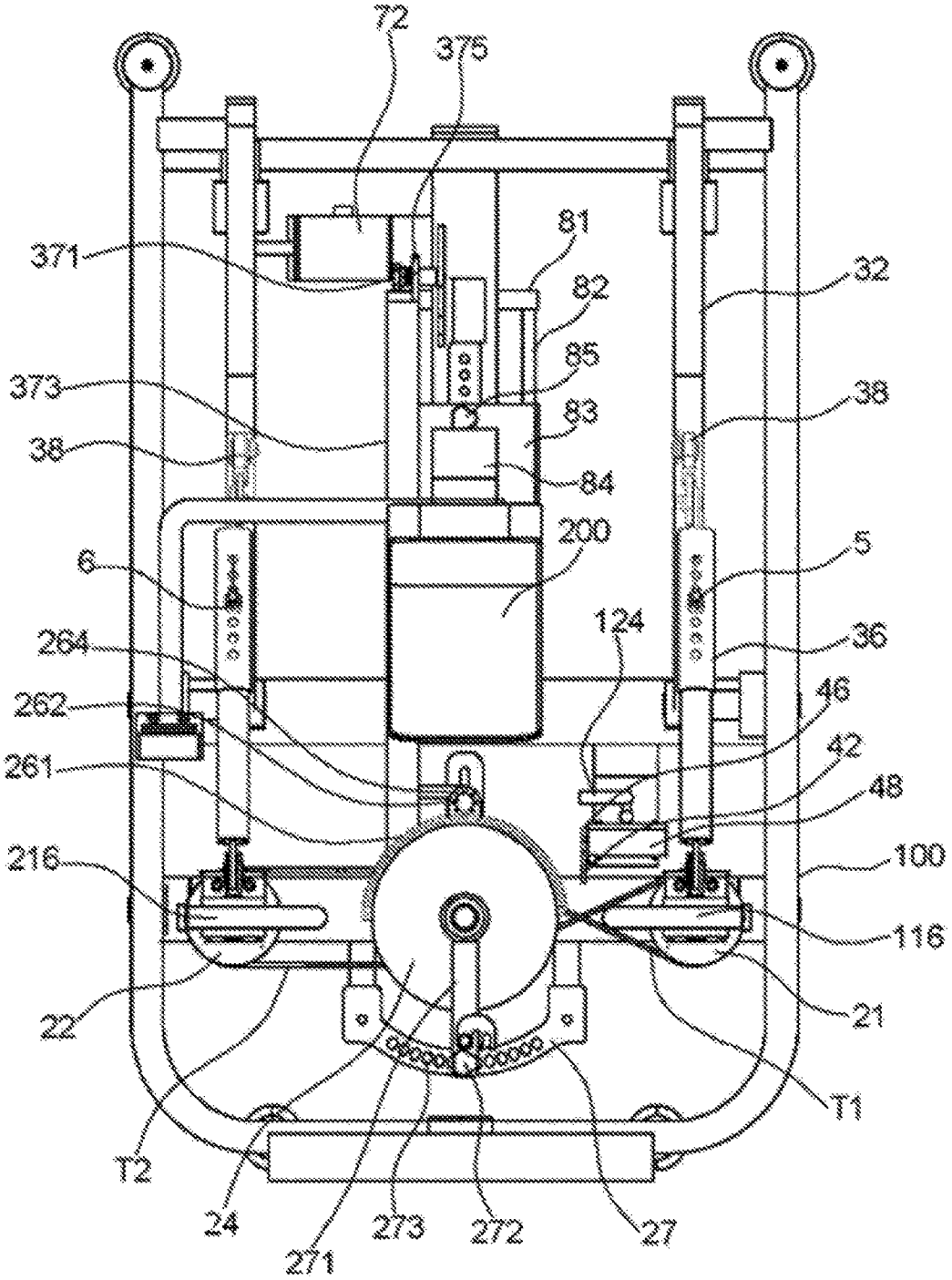

[FIG. 21]
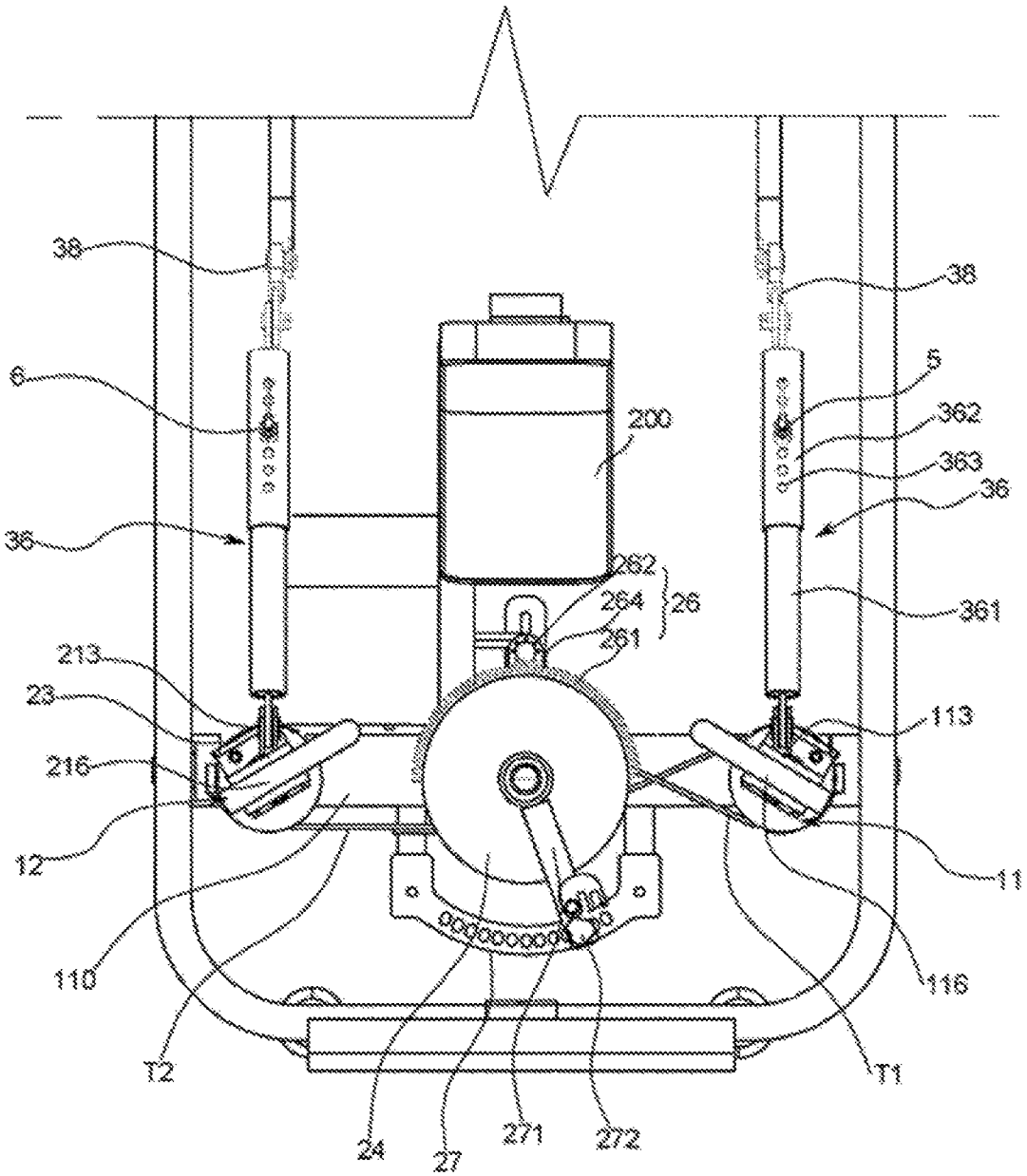

[FIG. 22]
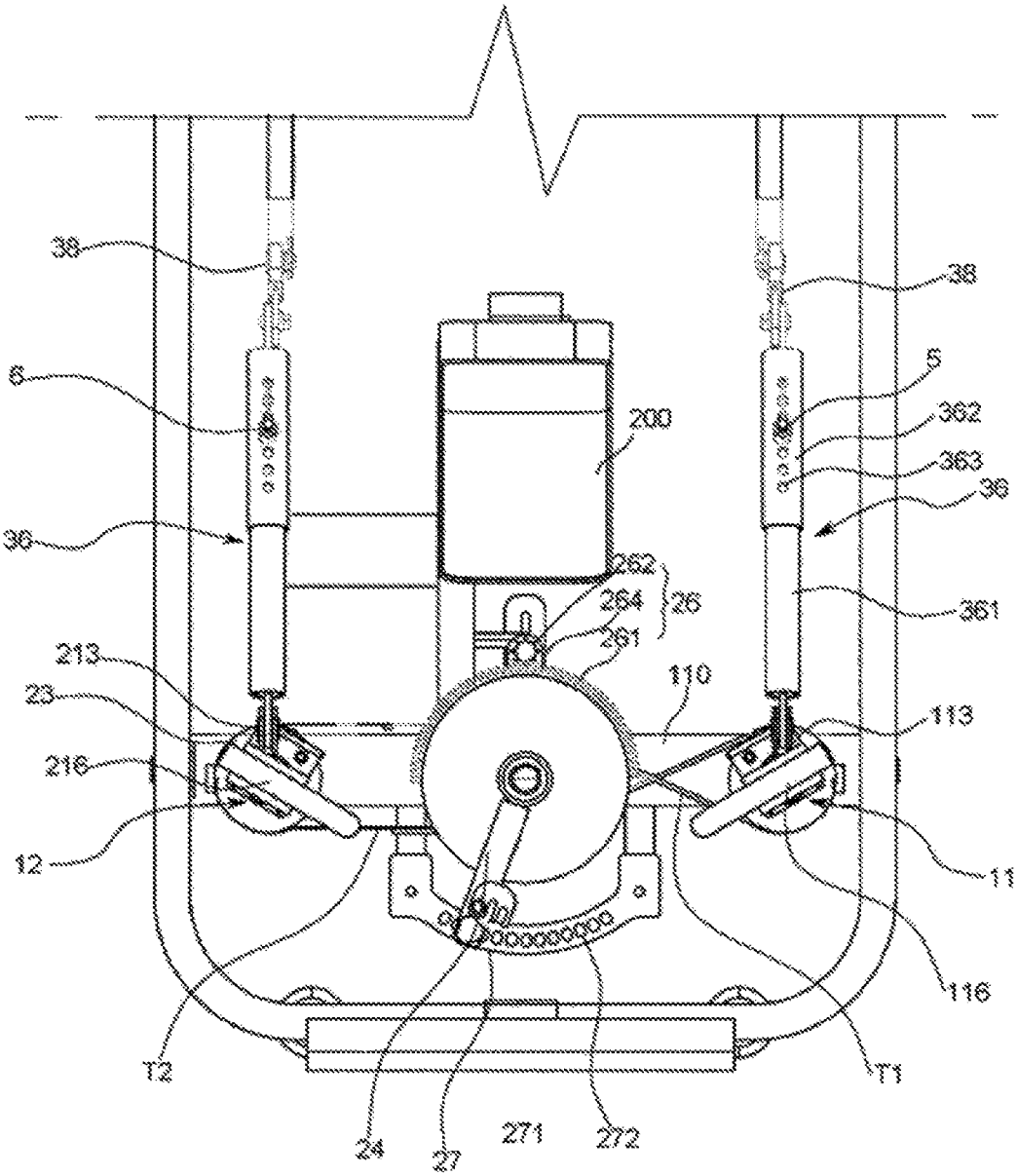

[FIG. 23]
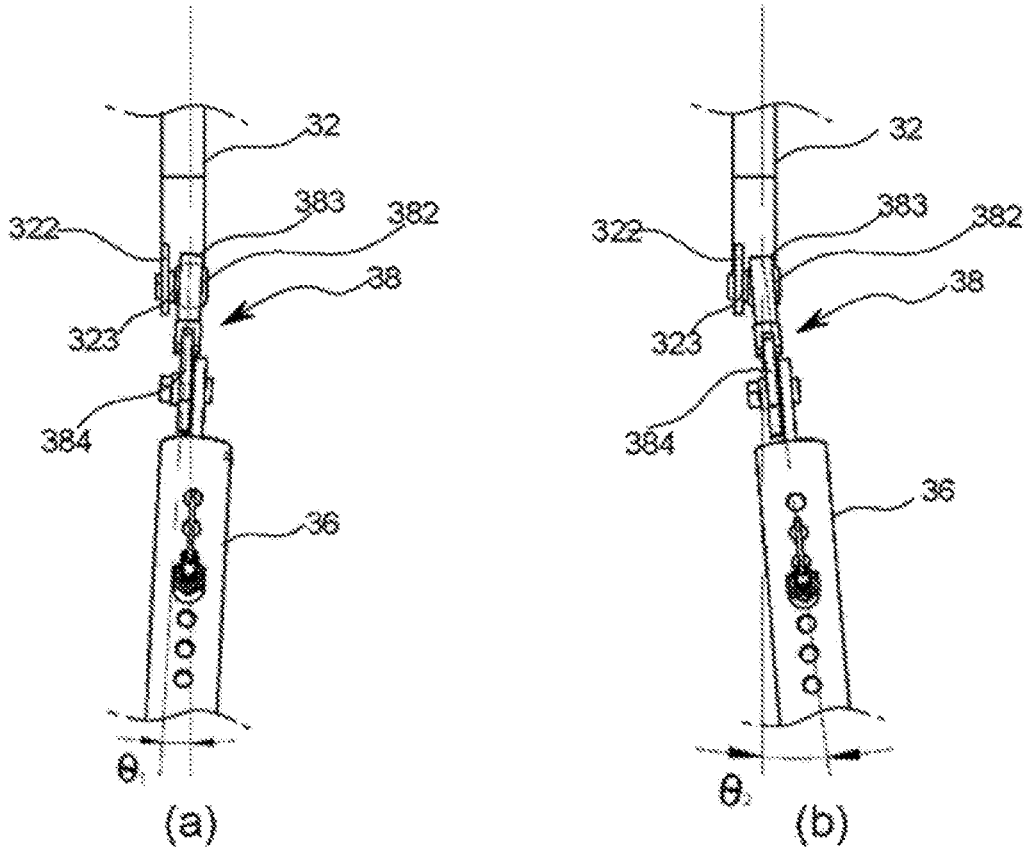

WEIGHT TRAINING EQUIPMENT WITH ADJUSTABLE HANDLE ANGLE

TECHNICAL FIELD

The present invention relates to a weight training apparatus, and more particularly, to a weight training apparatus capable of variously adjusting an angle of handles of a machine that uses a weight of stacked bricks and a hammer type exercise apparatus providing an exercise load by adding or subtracting a weight of a circular plates according to a type of providing an exercise load of the weight training apparatus manually or electrically.

BACKGROUND ART

Unless defined otherwise herein, contents described in this section are not related arts with respect to the claims of the application, and the contents included in this section are not bound to be acknowledged as the related arts.

Exercise executed in a gym may be classified into aerobic exercise and exercise using machines which is referred to as anaerobic exercise.

Exercise using machines may be classified, according to an exercise purpose, into upper body muscle exercise, lower body muscle exercise, abdominal muscle exercise, and the like.

As a representative exercise machine for upper body muscle exercise among these, there are a chest press, an incline chest press, a decline chest press, a shoulder machine, a long pull machine, and a hammer type exercise machine.

In the above-described currently existing exercise machines, since an angle of pushing or pulling a handle is specified and fixed as a single angle, it is impossible to variously stimulate a corresponding muscle part.

RELATED ART DOCUMENT

Patent Document (Patent Document 1) Korean Patent Application No. 10-2009-0046865

DISCLOSURE

Technical Problem

The present invention is directed to providing a weight training apparatus capable of variously adjusting an angle of a handle so as to variously stimulate corresponding muscles for each part thereof.

Technical Solution

One aspect of the present invention provides a weight training apparatus in which an angle of a handle is adjustable, for example, a chest press for doing pectoral muscle exercise. The weight training apparatus includes a base frame mounted on the ground, a chair formed above the base frame to allow an exerciser to sit thereon, first and second exercise bars hinge-coupled with both sides of a front of the chair to be pushed or pulled forward or backward by the exerciser, and a weight portion including connecting rods connected to one sides of the first and second exercise bars and weight members formed on the connecting rods to provide a weight. The weight training apparatus includes a means for adjusting torsion angles of the first and second exercise bars by rotating the first and second exercise bars.

Advantageous Effects

According to the disclosed embodiments, an effect is provided of variously adjusting an angle of a handle so as to variously stimulate corresponding muscles for each part thereof.

DESCRIPTION OF DRAWINGS

FIG. 1 is a front perspective view of a weight training apparatus according to Embodiment 1 of the present invention;

FIG. 2 is a left-rear perspective view of the weight training apparatus according to Embodiment 1 of the present invention;

FIG. 3 is an exploded perspective view of the weight training apparatus according to Embodiment 1 of the present invention;

FIGS. 4 and 5 are left side views of the weight training apparatus according to Embodiment 1 of the present invention;

FIGS. 6 and 7 are plan views illustrating an operation of a torsion angle adjusting means of the weight training apparatus according to Embodiment 1 of the present invention;

FIG. 8 is a perspective view illustrating an operation of the torsion angle adjusting means of the weight training apparatus according to Embodiment 1 of the present invention;

FIG. 9 is a side view illustrating a state before an operation of a rotation plate tilting means of the weight training apparatus according to Embodiment 1 of the present invention;

FIG. 10 is a side view illustrating a state after an operation of the rotation plate tilting means of the weight training apparatus according to Embodiment 1 of the present invention;

FIG. 11 is an exemplary view of a chair adjusting means of the weight training apparatus according to Embodiment 1 of the present invention;

FIG. 12 is a partial enlarged perspective view illustrating another example of a first stopper of the weight training apparatus according to Embodiment 1 of the present invention;

FIG. 13 is an enlarged partial view illustrating the first stopper of FIG. 12;

FIG. 14 is an enlarged partial view illustrating a second stopper of FIG. 12;

FIG. 15 is a front perspective view of a weight training apparatus according to Embodiment 2 of the present invention;

FIG. 16 is a left-rear perspective view of the weight training apparatus according to Embodiment 2 of the present invention;

FIG. 17 is an enlarged significant part view of the weight training apparatus according to Embodiment 2 of the present invention;

FIG. 18 is a right-rear perspective view of the weight training apparatus according to Embodiment 2 of the present invention;

FIG. 19 is a side view of the weight training apparatus according to Embodiment 2 of the present invention;

FIG. 20 is a plan view of the weight training apparatus according to Embodiment 2 of the present invention;

FIGS. 21 and 22 are plan views illustrating rotating operations of first and second exercise bars of the weight training apparatus according to Embodiment 2 of the present invention, in which FIG. 21 is an exemplary view illustrating the first and second exercise bars which have been rotated toward a body, and FIG. 22 is an exemplary view illustrating the first and second exercise bars which have been rotated outward; and FIG. 23 is a view illustrating an operation of an angle variation accommodation portion of the weight training apparatus according to Embodiment 2 of the present invention, in which FIG. 23(*a*) is an exemplary view illustrating a state in which the angle variation accommodation portion is refracted toward a body and FIG. 23(*b*) is an exemplary view illustrating a state in which the angle variation accommodation portion is refracted outward.

MODES OF THE INVENTION

Hereinafter, exemplary embodiments classified into Embodiments 1 and 2 will be described in detail with reference to the attached drawings.

The embodiments which will be described below are merely for explaining the present invention to allow one of ordinary skill in the art to easily implement the present invention but are not intended to limit the technical concept and scope of the present invention. Also, sizes, shapes, or the like of components shown in the drawings may be exaggerated for clarity and convenience of description. It should be noted that the terms particularly defined in consideration of components and operations of the present invention may vary according to the intention of a user or operator or custom and should be defined on the basis of content over an entirety of the specification.

Embodiment 1

FIGS. 1 to 14 among the attached drawings illustrate Embodiment 1.

As shown in FIGS. 1 to 14, a weight training apparatus in which an angle of a handle is adjustable according to the present invention includes a base frame 100 mounted on the ground, a chair 200 formed above the base frame 100 to allow an exerciser to sit thereon, first and second exercise bars 11 and 12 hinge-coupled with both sides of a front surface of the chair 200 to be pushed forward by the exerciser, a weight portion 300 including connecting rods 29 connected to one sides of the first and second exercise bars 11 and 12, and weight members R formed on the connecting rods 29 to provide a weight, and a torsion angle adjusting means 2 configured to rotate the first and second exercise bars 11 and 12 to adjust torsion angles thereof.

The exerciser may change a part of a pectoral muscle which is stimulated by adjusting an angle by rotating the first and second exercise bars 11 and 12 on both sides while sitting in the chair 200 using the torsion angle adjusting means 2 (here, rotation means rotating in place while tilting).

Since the angle is changed by rotating the first and second exercise bars, an outside, a center, and an inside of the pectoral muscle may be separately stimulated.

The torsion angle adjusting means 2 includes first and second rotating plates 21 and 22 which are rotatably formed on both sides of a lower support 140 and above which first brackets 23, to which the first and second exercise bars 11 and 12 are hinge-coupled, are formed, a rotating force transfer means connected to outer circumferences of the first and second rotating plates 21 and 22 to be pressed thereagainst and configured to transfer rotating forces to rotate the first and second rotating plates 21 and 22 in opposite directions with respect to each other, and a torsion angle fixing member 25 configured to fix a rotational angle of at least one of the first and second rotating plates 21 and 22. The rotating force transfer means may be a belt 24.

The torsion angle fixing member 25 may include a cantilever bracket 252 formed to be perpendicular to a top surface of the base frame 100 and disposed to be horizontal to a top of the first rotating plate 21 and may include a main stopper 254 passing through and vertically coupled with the cantilever bracket 252 and insertion-coupled with any one of a plurality of angle adjusting holes 253 formed in the first rotating plate 21. The main stopper 254 may have a structure in which a pin sprung up by a spring is inserted into one of the angle adjusting holes 253.

Accordingly, when the main stopper 254 is separated from the angle adjusting hole 253 and then any one or both of the first and second exercise bars 11 and 12 are rotated at the same time, the first and second rotating plates 21 and 22 rotated at the same time by being connected to the rotational force transfer means 24 such that it is possible to adjust the torsion angles of the first and second exercise bars 11 and 12.

The first and second exercise bars 11 and 12 are coupled to be symmetrical in the same shape on both sides.

Looking at the shape of the first and second exercise bars 11 and 12, vertical rod bodies 112 and 212 are vertically coupled with the first brackets 23 and formed as round bars, bending portions 114 and 214 are formed at top ends of the vertical rod bodies 112 and 212 to be bent, and handles 116 and 216 are laterally formed at top ends of the bending portions 114 and 214.

Here, ends of the handles 116 and 216 are formed to correspond to central lines of the vertical rod bodies 112 and 212.

The bending portions 114 and 214 may have a variety of shapes such as a staple shape, an arc shape, and the like.

Accordingly, due to the shape of the first and second exercise bars 11 and 12, even when the first and second exercise bars 11 and 12 are rotated as shown in FIGS. 6 and 7, a grip position of hands does not deviate from a central point of the rotating plate 21.

Also, the outside, the center, and the inside of the pectoral muscle may be stimulated as intended by changing an angle thereof by rotating the first and second exercise bars 11 and 12.

Since bottom ends of the first and second exercise bars 11 and 12 are pivotably installed while passing through holders 61 formed on connecting rods, such that the connecting rods 29 remain in original positions without angular variation even when the exercise bars 11 and 12 are rotated rightward or leftward. When the holders 61 are not present, the first and second exercise bars 11 and 12 and the connecting rods 29 move together such that second leveling members 633 of weight supports 63, into which circular plates 300 are fit, move according thereto. Accordingly, a great force is necessary for adjusting rotation of the exercise bars, and vertical bars 150 and inclined bars 160 collide with each other.

As shown in FIG. 6, there is performed an exercise of rotating the first and second exercise bars 11 and 12 in one direction for the first and second exercise bars 11 and 12 to be pushed to be directed toward an outside of a body.

Referring to FIG. 8, such an exercise corresponds to a position indicated as (c). Exercise in this state stimulates an outside of a pectoral muscle.

Otherwise, as shown in FIG. 7, there is performed an exercise of rotating the first and second exercise bars 11 and 12 in the other direction for the first and second exercise bars 11 and 12 together to be pushed to be directed toward an inside of the body.

Referring to FIG. 8, such an exercise corresponds to a position indicated as (a). Exercise in this state stimulates an inside of the pectoral muscle.

Referring to FIG. 8, exercise in a position indicated as (b) stimulates a center of the pectoral muscle.

For convenience of description, a torsion operation with respect to only the first exercise bar 11 on a right side is shown in FIG. 8. Although not shown in the drawings, it should be noted that a torsion operation with respect to the second exercise bar 12 on a left side may also be performed equally to the first exercise bar 11.

Meanwhile, the disclosed embodiment includes a rotating plate tilting means 3 which adjusts a tilting angle by tilting the first and second rotating plates 21 and 22.

The rotating plate tilting means 3 according to one embodiment includes, as shown in FIGS. 1 to 5, the lower support 140 being rotated while both ends are pin-coupled with second brackets 142 formed on both sides of the top surface of the base frame 100 and having a top surface with which the first and second rotating plates 21 and 22 are pivotably hinge-coupled, the inclined bars 160 having one ends connected to the lower support 140 and inclined upward toward the other sides, an angle adjusting plate 180 being formed on the vertical bars 150 vertically formed in the rear of the base frame 100 and including a plurality of angle adjusting holes 181 formed therein, and a first stopper 190 being inserted into one of the angle adjusting holes 181 while passing through the other ends of the inclined bars 160.

The first and second rotating plates 21 and 22 may be installed by forming a bearing housing in a central part and mounting the bearing housing on a shaft formed at the lower support 140.

The first stopper 190 includes a circular pipe, a pin coupled with a spring inserted in the circular pipe and inserted into the angle adjusting hole 181, and a knob formed at an end of the pin.

Accordingly, when the knob is held and pulled, the pin is extracted from the angle adjusting hole 181. When the knob is released, the pin is led to the angle adjusting hole 181 due to elasticity of the spring and becomes fixed.

Referring to FIGS. 4 and 9, when the first stopper 190 is inserted into a top of the angle adjusting hole 181, the first and second rotating plates 21 and 22 become horizontal and the first and second exercise bars 11 and 12 become vertical.

Meanwhile, referring to FIGS. 5 and 10, when the first stopper 190 is inserted into a bottom of the angle adjusting hole 181, the first and second rotating plates 21 and 22 become inclined and the first and second exercise bars 11 and 12 tilt so as to be adjusted to be close toward the body.

Meanwhile, according to another embodiment, as shown in FIGS. 12 to 14, a cable unit 67, in which second stoppers 65 on both sides are also separable in conjunction with an operation of separating the first stopper 190, may be included.

The connecting rods 29 are provided on both sides of the first and second exercise bars 11 and 12 and the second stoppers 65 are formed on the connecting rods 29, which will be described below in detail while exercise bar tilting means 6 are described.

One end of the cable unit 67 is connected to the first stopper 190, and the other end thereof is connected to the second stopper 65.

The second stopper 65 includes a circular pipe, a pin coupled with a spring inserted in the circular pipe and inserted into a long hole 642 of a tilt adjusting member 64 and a pinhole of the connecting rod 29, and a knob formed at an end of the pin.

The cable unit 67 includes an external tube body 672 in which a wire 671 is inserted. Referring to FIG. 13, one end of the wire 671 is connected to a bracket 677 fixed to the first stopper 190. Also, the other end of the wire 671 is connected to the pin of the second stopper 65 as shown in FIG. 19.

One end of the external tube body 672 is fixed to the inclined bar 160 and the other end is fixed to an L-shaped bracket 674 mounted on and protruding from a panel 645 of the tilt adjusting member 64.

Accordingly, the first stopper 190 is pulled outward, the wire 671 is pulled and the second stopper 65 on the other side is also pulled according thereto and thus an operation of separating the second stopper 65 may be in conjunction therewith.

That is, since the other end of the external tube body 672 is fixed to the bracket 674 and only the wire 671 is pulled, the second stopper 65 and the second stopper on the other side are pulled at the same time.

According to one embodiment, the exercise bar tilting means 6 rotated according to the rotating plate tilting means 3 to adjust the angle of the first and second exercise bars 11 and 12 is included.

The exercise bar tilting means 6 includes, as shown in FIG. 1, the connecting rods 29 having one ends at which the holders 61 rotatably interference fit with outer circumferential surfaces of the first and second exercise bars 11 and 12 having bottom ends pin-coupled with the first brackets 23 formed on top surfaces of the first and second rotating plates are formed and having the other ends at which pinholes (not shown) are formed so as to be coupled with the first and second exercise bars 11 and 12 and includes an insertion rod 310 formed on the weight support 63 which includes a first horizontal member 631 hinge-coupled with one side of the base frame 100, a vertical member 632 vertically formed at one end of the first horizontal member 631, and a second horizontal member 633 formed at a top end of the vertical member 632 where the weight member R is mounted on an end of the second horizontal member 633.

Also, as shown in FIG. 3, the tilt adjusting member 64 in which the long hole 642 formed in the vertical member 632 and corresponding to the pinhole of the connecting rod 29 is longitudinally formed so as to adjust rotation angles of the connecting rods 29 on both sides is formed on each of the connecting rods 29.

Also, the second stoppers 65 coupled with the long holes 642 of the tilt adjusting members 64 and passing through and coupled with the pinholes of the connecting rods 29 so as to set the rotation angles of the connecting rods 29 on both sides are formed at the connecting rods 29.

One end of the first horizontal member 631 of the weight support 63 may be rotated while being coupled with the base frame 100 through a shaft 635 having a bearing interposed therein (refer to FIG. 2 or 4).

The tilt adjusting member 64 is formed by disposing two panels 645 spaced apart from each other on inner and outer sides and fastened using a plurality of bolts. The long hole 642 is formed in an outer panel, and a plurality of pin-fastening holes corresponding to the long hole are formed in an inner panel.

The other end of the connecting rod 29, that is, a part in which the pinhole is formed, is inserted between the two panels 645 and fixed by the second stopper 65 passing through the long hole 642 and being coupled with the pin-fastening hole.

The tilt adjusting member 64 is attached to and integrated with the vertical member of the weight support.

As shown in FIG. 5, when the first stopper 190 of the rotating plate tilting means 3 is released and then the lower support 140 is moved downward and rotated, the first and second rotating plates 21 and 22 thereunder are rotated to tilt upward and the first and second exercise bars 11 and 12 are also rotated to tilt such that a distance between the handles 116 and 216 and a user decreases and the chair 200 is moved toward a rear of a body by as much as the decreased distance and then the first and second exercise bars 11 and 12 are pushed forward to perform an operation.

Each of the connecting rods 29 is rotated upward and downward, and the tilt adjusting member 64 coupled with the connecting rod 29 is rotated upward and downward.

The second horizontal member 633 connected to the tilt adjusting member 64 and the weight support 63 with the weight member R mounted on an end of the second horizontal member 633 are rotated upward and downward in conjunction with each other so as to stimulate an upper part of the pectoral muscle.

The weight support 63 includes the first horizontal member 631, the vertical member 632, and the second horizontal member 633. The insertion rod 310 is formed at the end of the second horizontal member 633, and the weight member R is mounted on the insertion rod 310.

In addition, when the first stopper 190 of the rotating plate tilting means 3 is released and then the lower support 140 is moved upward and rotated, the first and second rotating plates 21 and 22 thereunder are rotated to tilt downward and the first and second exercise bars 11 and 12 are also rotated to tilt such that the distance between the handles 116 and 216 and the user increases.

The chair 200 is moved toward a front of the body by as much as the handles 116 and 216 become farther away and then when the first and second exercise bars 11 and 12 are pushed forward to perform an operation, the connecting rods 29 are rotated upward and downward and the tilt adjusting member 64 coupled with the connecting rods 29 is rotated upward and downward.

The second horizontal member 633 connected to the tilt adjusting member 64 and the weight support 63 with the weight member R mounted on an end of the second horizontal member 633 are rotated upward and downward in conjunction with each other so as to stimulate a lower part of the pectoral muscle.

The weight member R to which a circular weight plate is applied may set a weight by coupling an adequate number of circular weight plates with the insertion rod 310 formed at the weight support 63.

Otherwise, although not shown in the drawings, the present invention is also applicable to an apparatus of a so-called "machine" which provides an exercise load by stacking brick-shaped stacks by connecting a wire to an end of the second horizontal member 633 of the weight support 63.

Meanwhile, the base frame 100 includes a chair adjusting means 8 adjusting a back-and-forth distance of the chair 200.

The chair adjusting means 8, as shown in FIG. 11, includes a plurality of brackets 81 attached to a side surface of the base frame 100, a guide rod 82 with both ends coupled with and horizontally mounted on the plurality of brackets 81, a chair frame 84 on which the chair 200 is attached, an operating panel 83 on which the chair frame 84 is mounted and having one end on which a guide holder 87, which is coupled with the guide rod 82 to horizontally slide thereon, is formed, and a fifth stopper 85 passing through and coupled with the operating panel 83 and selectively coupled with a plurality of adjusting holes 108 formed in the base frame 100 to provide a fixing force.

An adequate position of the chair 200 is set by moving the chair 200 forward or backward according to tilting of the first and second exercise bars 11 and 12 and then the fifth stopper 85 is inserted into and fixed to the adjusting hole 108 so as to do exercise.

Embodiment 2

Attached FIGS. 15 to 23 illustrate Embodiment 2 of the present invention.

As shown in the drawings, the weight training apparatus capable of adjusting angles of handles according to the present invention includes a base frame 100 mounted on the ground, a chair 200 formed above the base frame 100 to allow an exerciser to sit thereon, first and second exercise bars 11 and 12 hinge-coupled with both sides of a front surface of the chair 200 to be pushed forward by the exerciser, and a weight portion including connecting rods 32 connected to one sides of the first and second exercise bars 11 and 12 through connecting bars 36 and a weight member R formed on the connecting rods 32 to provide a weight. The weight training apparatus includes an exercise bar rotating portion 2 which adjusts a torsion angle by manually or electrically rotating the first and second exercise bars 11 and 12 leftward or rightward, an inclined angle adjusting portion 3 which adjusts a tilt angle by tilting the exercise bar rotating portion 2, and an angular variation accommodating portion allowing the connecting rods to vertically move by accommodating variations in rotation angles and vertical angles of the first and second exercise bars. Also, a control portion 400 in which a display panel is provided for electrical control may be further included.

The exercise bar rotating portion 2 may allow the exerciser to change a part of a pectoral muscle which is stimulated by adjusting an angle by rotating the first and second exercise bars 11 and 12 on both sides while sitting in the chair 200.

It is possible to dynamically stimulate a variety of an outer side, a center, an inner side, and the like of the pectoral muscle by changing an angle through rotating the first and second exercise bars 11 and 12.

The exercise bar rotating portion 2 includes first and second rotating plates 21 and 22 which are rotatably formed, spaced apart from each other, on both sides of a top of a support frame 110 with both ends hinge-coupled with the base frame 100, and above which first brackets 23 hinge-coupled with the first and second exercise bars 11 and 12 are formed, a main circular plate 24 formed between the first and second rotating plates 21 and 22, rotatably coupled with a center of the top of the support frame 110, and including a gear on an outer circumference, an angle adjusting means which adjusts a rotation angle of the main circular plate 24, a first rotating force transfer means which transfers a rotating force between the first rotating plate 21 and the main circular plate 24, and a second rotating force transfer means which transfers a rotation force between the second rotating plate 22 and the main circular plate 24.

As shown in FIG. 15, the angle adjusting means may include a bar 271 connected from a central part to an outer circumference of a top of the main circular plate 24, a main stopper 272 coupled with an end of the bar 271, and a horizontal angle adjusting plate 27 formed outside the main circular plate 24 and in which a plurality of angle adjusting holes 273 are formed to allow the main stopper 272 to be insertion-coupled therewith.

The main stopper 272 may be a solenoid (not shown), a pin sprung up by a spring (not shown), and the like so as to protrude when necessary and be inserted into the angle adjusting hole 273.

Meanwhile, the first rotating force transfer means may be a first belt T1 which connects the first circular plate 21 to a pulley 242 of the main circular plate 24, and the second rotating force transfer means may be a second belt T2 which connects the second rotating plate 22 to the pulley 242 of the main circular plate 24. However, the present invention is not limited thereto and any components capable of transferring a rotating force as desired are acceptable. Hereinafter, the first belt T1 and the second belt T2 will be described as an example.

The first and second exercise bars 11 and 12 are formed such that rotational directions of the first belt T1 and the second belt T2 are opposite to each other so as to rotate in mutually opposite directions.

Preferably, the first belt T1 may have an 8 shape and the second belt T2 may have an elliptical shape.

A fixing clip 275 is hinge-coupled with one side of a top surface of the bar 271 and performs an operation of fixing the main stopper 272 in a state in which the main stopper 272 has moved upward.

the main stopper 272 is locked by moving the main stopper 272 up and rotating the fixing clip 275 toward the main stopper 272 such that angles of the first and second exercise bars 11 and 12 may be operated freely to be pushed or pulled according to an intention of a user so as to obtain a free exercise angle effect such as when exercising with dumbbells.

Rotational operations of the first and second exercise bars 11 and 12 will be described.

As shown in FIGS. 21 and 22, the main stopper 272 is moved upward to be separated from the angle adjusting hole 273 and then the bar 271 is rotated leftward or rightward such that the main circular plate 24 is rotated.

When the main circular plate 24 is rotated, opposite rotations of the first and second belts T1 and T2 are performed and the first and second circular plates 21 and 22 to which the first and second belts T1 and T2 are connected are oppositely rotated. Accordingly, the first and second exercise bars 11 and 12 connected to the first and second circular plates 21 and 22, respectively, are oppositely rotated. The above-described rotation means rotation in place.

When the main circular plate 24 is rotated at an adequate angle and the main stopper 272 which has been moved upward is released, the main stopper 272 is led into the angle adjusting hole 273 such that the angle is fixed.

The angles of the handles 116 and 216 may be adjusted by rotating the first and second exercise bars 11 and 12 as described above.

The first and second exercise bars 11 and 12 are formed on both sides to be symmetrical to each other on the basis of the chair 200, and the handles 116 and 216 thereabove may be formed to be symmetrical.

The first exercise bar 11 includes a lower rod body 111 hinge-coupled with a connecting portion 23 formed on a top surface of the first rotating plate 21 using a shaft pin to be vertically formed as a round bar, a holder 113 interference fit with a top of the lower rod body 111 and in which a bearing coupled with the lower rod body 111 is formed to be rotatable, an upper rod body 112 vertically interference fit with a top of the holder 113, and the handle 116 formed at a top end of the upper rod body 112.

The second exercise bar 12 includes a lower rod body 211 hinge-coupled with a connecting portion 23 formed on a top surface of the second rotating plate 22 using a shaft pin to be vertically formed as a round bar, a holder 213 interference fit with a top of the lower rod body 211 and in which a bearing coupled with the lower rod body 211 is formed to be rotatable, an upper rod body 212 vertically interference fit with a top of the holder 213, and the handle 216 formed at a top end of the upper rod body 212.

Each of the handles 116 and 216 has a staple shape or a C shape including upper and lower horizontal bars and a vertical bar having an opening directed toward the chair 200.

Particularly, middle points of upper bars where the handles 116 and 216 are gripped by hands coincide with rotating shafts of the upper rod bodies 112 and 212 such that positions of parts gripped by the hands are not changed even when the first and second exercise bars 11 and 12 are rotated.

Accordingly, the outside, the center, and the inside of the pectoral muscle may be stimulated as intended by changing an angle thereof by rotating the first and second exercise bars 11 and 12.

Since the holders 113 and 213 are mounted, even when the exercise bars 11 and 12 are rotated rightward and leftward in place, the connecting rods 32 and the connecting bars 36 remain in original positions without angular variations.

It is possible to exercise while subdividing the inside, center, and outside of the pectoral muscle by rotating the first and second exercise bars 11 and 12 to be directed toward an outside or inside of a body.

For example, as shown in FIG. 22, when a push exercise is executed while the angles of the first and second exercise bars 11 and 12 are changed to be directed to the outside of the body, the outside of the pectoral muscle may be stimulated. Otherwise, as shown in FIG. 21, when an exercise of pushing the first and second exercise bars 11 and 12 to be gathered toward the inside of the body is executed, the inside of the pectoral muscle is stimulated.

As shown in FIG. 20, when an exercise of pushing the first and second exercise bars 11 and 12 from a center of the body is executed, the center of the pectoral muscle is stimulated.

The above-described method of using the main stopper 272 may include electrically adjusting a rotational angle.

In an example of electrically adjusting the rotational angle, an electrical angle adjusting portion 26 is further included which automatically sets the rotational angle of the main circular plate 24 using a first motor 264.

As shown in FIGS. 16 and 17, the electrical angle adjusting portion 26 includes a gear portion 261 including a plurality of gears formed on an outer circumference of the main circular plate 24, a first motor 264 which is mounted on the support frame 110 and at which a pinion gear 262 gear-engaged with the gear portion 261 is formed, and a fixing portion 28 on which the first motor 264 is mounted and slidably moved.

The fixing portion 28 includes a support plate 281 connected to the support frame 110, a moving plate 282 mounted on a top surface of the support plate 281, and a vertical rod 283 vertically formed on the moving plate 282, and the first motor 264 is mounted on a top of the vertical rod 283.

The moving plate 282 and the support plate 281 each include an adjusting long hole 284 and a moving plate stopper 285 coupled with the adjusting long hole 284 to perform a fixing operation or releasing operation.

Accordingly, when the moving plate stopper 285 is released and the moving plate 282 is moved backward, the first motor 264 and the pinion gear 262 connected thereto are separated from the gear portion 261.

In this state, it is possible to manually set an adequate angle by rotating the bar 271 of the exercise bar rotating portion 2 manually.

On the other hand, when the pinion gear of the first motor 264 is coupled with the gear portion of the main circular plate by moving the moving plate 282 forward and then is fixed thereto by tightening the moving plate stopper 285 and then the first motor 264 is driven, the main circular plate 24 may be electrically rotated.

Here, a solenoid valve (not shown) mounted on the main stopper 272 fixing the rotational angle of the main circular plate 24 may move up the main stopper 272 in advance according to a signal of the control portion 400 to be maintained as being separated from the angle adjusting hole 273.

An angle sensor portion 265 sensing the rotational angle of the main circular plate 24 is included.

The angle sensor portion 265 includes a plurality of contact points 266 formed below the main circular plate 24 and arranged in an arc shape close to the gear portion 261 and a sensor 267 formed above the first motor 264 to sense the plurality of contact points 266.

Accordingly, when the signal is transmitted from the control portion 400, the first motor 264 is driven and the pinion gear 262 is rotated such that the pinion gear 262 rotates the gear portion 261 and the main circular plate 24 by a certain angle.

The rotated angle is read by the angle sensor portion 265 and then is displayed by the control portion 400.

When the main circular plate 24 is rotated, the first belt T1 and the second belt T2 are oppositely rotated. Accordingly, the first and second rotating plates 21 and 22 coupled therewith are oppositely rotated and the first and second exercise bars 11 and 12 coupled with the first and second rotating plates 21 and 22 are rotated so as to adjust the angle.

Meanwhile, a vertical inclined angle adjusting portion 3 which adjusts an inclined angle of the exercise bar rotating portion 2 in a vertical direction is included.

The inclined angle adjusting portion 3 includes connecting bars 36 formed on both sides to connect the connecting rods 32 to holders 113 and 213 of the first and second exercise bars 11 and 12, pivoting portions 37 which each include an inclined bar 373 with one end formed to be inclined upward and connected to the support frame 110 and with the other end on which a third stopper 371 is formed and an angular plate 375 formed at a top of a rear of the base frame 100 to correspond to a rear end of the inclined bar 373 and including a plurality of angle adjusting holes formed in a longitudinal direction to allow the third stopper 371 to be coupled therewith, and angle variation accommodation portions 38 which connect the connecting rods 32 to the connecting bars 36, accommodate angle variations in upward, backward, leftward, and rightward directions of the first and second exercise bars 11 and 12, and transfer forward and backward operations of the first and second exercise bars 11 and 12 to the connecting rods 32.

In each of the both connecting bars 36, a first pipe 361 having one end hinge-coupled with the holder 113 or 213 of the first or second exercise bar 11 or 12 is insertion-coupled with a second pipe 362 with one end hinge-coupled with the angle variation accommodating portion 38. Here, a plurality of length adjusting holes 363 are formed in the first pipe 361, and a first stopper 5 and a second stopper 6 coupled at positions corresponding to the length adjusting holes 363 of the first pipe 361 and providing fixing forces are included in the second pipe 362.

Each of the third stopper 371, the first stopper 5, and the second stopper 6 includes a circular pipe, a pin coupled with a spring inserted in the circular pipe and inserted into the length adjusting hole 363, and a cable unit 55 connected to the pin.

Accordingly, when the cable unit 55 is pulled, the pin escapes from the length adjusting hole 363. When the cable unit 55 is released, due to elasticity of the spring, the pin is led into the length adjusting hole 363 to be in a fixed state so as to be manually operated.

Since one side of the cable unit 55 is connected to the third stopper 371 and the other end thereof is connected to the first stopper 5 and the second stopper 6 in series, when the third stopper 371 is operated, the cable unit 55 is pulled such that the first stopper 5 and the second stopper 6 are also pulled and released.

To describe an operation of the inclined angle adjusting portion 3, the inclined bar 373 is connected to the support frame 110 and is moved up or down and the angle is fixed to the angle adjusting hole of the angular plate 375 using the third stopper 371.

When the inclined bar 373 is moved up or down, a length of the connecting bar 36 is changed. Consequently, in a structure in which the first pipe 361 and the second pipe 362 of the connecting bar 36 are coupled with each other, since it is necessary that long holes are formed in the first pipe 361 of the connecting bar 36, the first stopper 5 or second stopper 6 is mounted on the second pipe 362, and the first stoppers 5 and second stoppers 6 are operated while the stopper 371 is operated, the cable unit 55 is used.

For example, when lengths of the connecting bars 36 are decreased, the first and second exercise bars 11 and 12 tilt toward a user's body. When the lengths of the connecting bars 36 are increased, the first and second exercise bars 11 and 12 become vertical.

The angle variation accommodating portion 38, as shown in FIGS. 16 and 23, includes a ball 382 on one side coupled with a hinge bracket 322 formed on the connecting rod 32 using a shaft pin 323 and a rod 384 with one end on which a joint 383 interference fit with the ball 382 is formed and with the other end hinge-coupled with the connecting bar 36.

When the rod 384 and the connecting bar 36 are rotated leftward or rightward, the joint 383 is rotated leftward or rightward while being coupled with the ball 382 so as to bend.

Also, since the joint 383 may be rotated upward or downward while being coupled with the ball 382 when the rod 384 and the connecting bar 36 rotate upward or downward, the first and second exercise bars 11 and 12 and the connecting bars 36 may be rotated upward, downward, leftward, and rightward.

Meanwhile, in order to separate the first stopper 5 and the second stopper 6 on the other side at the same time according to an operation of separating the third stopper 371, the cable unit 55 which connects the first stopper 5, the second stopper 6, and the third stopper 371 to one another is included.

The connecting bars 36 are provided on the first and second exercise bars 11 and 12 on both sides, the first and second stoppers 5 and 6 are formed on the second pipes 362 of the connecting bars 36, and the third stopper 371 is formed on the inclined bar 373 with one end connected to the support frame 110 and formed to be inclined upward.

The first stopper 5, the second stopper 6, and the third stopper 371 are connected by the cable unit 55. Accordingly, on side of the cable unit 55 is connected to the third stopper 371, and the other end thereof is connected to the first stopper 5 and the second stopper 6 in series.

The cable unit 55 which allows the first, second, and third stoppers 5, 6, and 371 to operate together includes a tube in which a wire is inserted. Here, one end of the wire is connected to the third stopper 371 and the other end thereof is connected to the first stopper 5 and the second stopper 6.

Accordingly, when the third stopper 371 is pulled outward, the wire of the cable unit 55 is pulled and the first and second stoppers 5 and 6 on the other side are also pulled according thereto such that operations of separating the first stoppers 5 and second stoppers 6 may be executed in conjunction with each other.

Meanwhile, a solenoid valve (not shown) may be included to electrically operate the first, second, and third stoppers 5, 6, and 371.

Preferably, only the third stopper 371 includes the solenoid valve and receives a signal of the control portion 400 and the solenoid valve of the third stopper 371 operates to separate the pin and pulls the cable unit 55 such that the first stoppers 5 and second stoppers 6 separately operate according to the cable unit 55.

A manual operation of the inclined angle adjusting portion 3 will be described.

A vertical angle adjusting portion 4 is released.

When the third stopper 371 is released, according thereto, the first stopper 5 and the second stopper 6 are released such that the inclined bar 373 becomes free.

Then, when the inclined bar 373 is moved up or down, the support frame 110 is rotated and the length of the connecting bar 36 changes according thereto.

When the angle is determined and the third stopper 371 is fixed, the first stoppers 5 and second stoppers 6 are also fixed at the same time according thereto.

Meanwhile, the vertical angle adjusting portion 4 which automatically sets a tilting angle of the inclined angle adjusting portion 3 using a second motor 48 is further included.

As shown in FIGS. 17, 18, and 19, the vertical angle adjusting portion 4 includes a fan-shaped gear 42 mounted on one surface of the support frame 110 with both ends hinge-coupled with the base frame 100 and with an outer circumference on which a gear is formed, the second motor 48 mounted on a plate 120 coupled with the base frame 100 and on which a pinion gear 46 gear-engaged with the fan-shaped gear 42 is formed, and an angle sensing portion 49 including a plurality of contact points 491 arranged in an arc shape on a side surface of the fan-shaped gear 42 and a sensor 492 formed on one side of the second motor 48 and configured to sense the plurality of contact points 491.

The plate 120 includes a length adjusting hole 121 with which a connecting pin 122 formed at the base frame 100 is coupled to pass therethrough, and a fixing handle 124 screw-coupled with one end of the length adjusting hole 121 and pressed against a top surface of the mounting frame 143 and configured to provide a fixing force of the plate 120.

Since the connecting pin 122 is coupled with the mounting frame 143 while passing through the length adjusting hole 121, the plate 120 may move forward and backward along the top surface of the mounting frame 143.

The connecting pin 122 has a rounded head on a top end to prevent the plate 120 from being separated therefrom while being movable along the length adjusting hole 121.

Accordingly, the fixing handle 124 may be released and the plate 120 may be moved forward and backward. While the connecting pin 122 is inserted in the length adjusting hole 121, the plate 120 may be moved forward and backward such that gear combination or separation is caused so as to control transfer or block power of the second motor 48 by controlling combination and separation between the pinion gear 46 and the fan-shaped gear 42.

For example, when the plate 120 is moved backward (toward the chair), the fan-shaped gear 42 and the pinion gear 46 are separated from each other such that power transfer of the second motor 48 may be blocked.

When changed to an electrical mode on a panel of the control portion 400, the third stopper 371, the first stopper 5, and the second stopper 6 are released by the solenoid. Then, when the second motor 48 is driven and the pinion gear 46 rotates the fan-shaped gear 42, as the support frame 110 is rotated, the angle may be set.

The set angle is recognized by the angle sensing portion 49 and then is displayed by the control portion 400.

Accordingly, since tilting of the first and second exercise bars 11 and 12 and the handles 116 and 216 may be adequately adjusted by changing an angle of the support frame 110, it is possible to set an angle adequate for a user.

According to the setting of the angle, stimuli may be concentrated at an upper part or lower part of pectoral muscles.

Meanwhile, a weight may be set by coupling an appropriate number of circular weight plates R with an insertion rod 321 formed at the connecting rod 32.

Otherwise, although not shown in the drawings, the present invention is also applicable to an apparatus of a so-called "machine" which provides an exercise load by stacking brick-shaped stacks by connecting a wire to an end of the second horizontal member 633 of the weight support 63.

Meanwhile, a self-generation portion which receives vertical rotation of the connecting rod 32 and generates power by rotating a rotor may be further included.

The self-generation portion, as shown in FIGS. 18 and 19, includes a generator 72 mounted on a rear of the base frame 100 and including a pulley 73 on a rotating shaft, a wire rope 74 with one end fixed to the connecting rod 32 and wound on the pulley 73 of the generator 72, and an elastic member 76 with one end coupled with an end of the wire rope 74 and the other end coupled with one side of the base frame 100 and elastically operated.

The elastic member 76 is a coil spring or an elastic band.

Accordingly, when the first and second exercise bars 11 and 12 are pushed or pulled forward or backward, the connecting rods 32 are rotated upward or backward, the wire ropes 74 connected to the connecting rods 32 reciprocate vertically, and the pulleys 73 repetitively rotate forward and backward such that the generator 72 is driven to generate power.

The elastic member 76 is a coil spring and performs a function of increasing a speed of the vertical reciprocating of the wire rope 74 while extending or contracting to improve power generation performance.

The generated power may be stored in a storage battery 77 to be used as power for a display of the control portion 400 and may also be used as power for the first motor 264 and the second motor 48.

A display lamp of the storage battery 77 is turned on when a power amount of the storage battery is an optimum level or less and an electrical outlet may be provided such that power is supplied from the outside to charge the storage battery 77.

Although the exemplary embodiments have been described above, it may be easily understood by one of skill in the art that a variety of amendments and modifications may be made without departing from the essentials and scope of the present invention and it is apparent that all the changes and amendments are included in the scope of the claims.

DESCRIPTION OF REFERENCE NUMERALS

Embodiment 1

| <Embodiment 1> | |
|---|---|
| 2: torsion angle adjusting means | 3: rotating plate tilting means |
| 4: tilt angle adjusting portion | 6: exercise bar tilting means |
| 8: chair adjusting means | |
| 11, 12: first and second exercise bars | 25: torsion angle fixing member |
| 26: rotation angle adjusting portion | 29: connecting rod |
| 100: base frame | 140: lower support |
| 180: angle adjusting plate | 190: first stopper |
| 200: chair | 252: cantilever bracket |
| 300: weight portion | |

| <Embodiment 2> | |
|---|---|
| 2: exercise bar rotating portion | 3: inclined angle adjusting portion |
| 4: vertical angle adjusting portion | 5: first stopper |
| 6: second stopper | 7: self-generation portion |
| 8: chair adjusting means | 11, 12: first and second exercise bars |
| 32: connecting rod | 21, 22: first and second rotating plate |
| 24: main circular plate | 27: horizontal angle adjusting plate |
| T1: first belt | T2: second belt |
| 26: electrical angle adjusting portion | 32: connecting rod |
| 34: support | 36: connecting bar |
| 37: pivoting portion | 38: angle variation accommodation portion |
| 42: fan-shaped gear | 48: second motor |
| 49: angle sensing portion | 55: cable unit |
| 72: generator | 74: wire rope |
| 76: elastic member | 77: storage battery |
| 82: guide rod | 84: chair frame |
| 83: operating plate | 85: fourth stopper |
| 100: base frame | 113, 213: holder |
| 116, 216: handles | 200: chair |
| 261: gear portion | 262: pinion gear |
| 264: first motor | 265: angle sensor portion |
| 371: third stopper | 400: control portion |

The invention claimed is:

1. A weight training apparatus comprising:

a chair formed above a base frame to allow an exerciser to sit thereon;

first and second exercise bars hinge-coupled with both sides of a front of the chair to be pushed forward or pulled backward by the exerciser;

a weight portion including connecting rods connected to sides of the first and second exercise bars and weight members formed on the connecting rods to provide a weight; and torsion angle adjusting means configured to adjust torsion angles of the first and second exercise bars by rotating the first and second exercise bars, wherein the torsion angle adjusting means comprises:

first and second rotating plates rotatably coupled with the base frame and having tops to which the first and second exercise bars are hinge-coupled;

rotating force transfer means configured to connect the first and second rotating plates and transfer a rotating force to allow the first and second rotating plates to be rotated in opposite directions; and a torsion angle fixing member configured to fix a rotational angle of any one of the first and second rotating plates.

2. The weight training apparatus of claim 1, wherein the torsion angle fixing member comprises:

a cantilever bracket formed to be perpendicular to a top surface of the base frame and horizontally disposed above the first rotating plate; and a main stopper configured to pass through and vertically couple with the cantilever bracket and couple with a plurality of angle adjusting holes formed in the first rotating plate.

3. The weight training apparatus of claim 1, wherein each of the first and second exercise bars comprises:

a vertical rod body vertically coupled with the first or second rotating plate and formed as a round bar;

a bending portion formed to be bent from a top end of the vertical rod body;

a handle horizontally formed at a top end of the bending portion, in which an end of the handle is formed to coincide with a central line of the vertical rod body, a holder interference fit with the vertical rod body, and a connecting rod coupled with the holder, and a second horizontal member.

4. The weight training apparatus of claim 1, further comprising rotating plate tilting means configured to adjust a tilt angle by tilting the first and second rotating plates, wherein the rotating plate tilting means comprises:

a lower support with both ends pin-coupled with second brackets formed on both sides of a top surface of the base frame and having a top surface with which the first and second rotating plates are pivotably hinge-coupled;

an inclined bar with one end connected to the lower support and gradually inclined upward toward the other side;

an angle adjusting plate formed on a vertical bar formed vertically in the rear of the base frame and including a plurality of angle adjusting holes therein; and a first stopper configured to pass through the other end of the inclined bar and inserted into the angle adjusting hole, and wherein the first stopper comprises a circular pipe and a pin coupled with a spring inserted in the circular pipe and inserted into the angle adjusting hole.

5. The weight training apparatus of claim 4, further comprising an exercise bar tilting means rotationally operated in conjunction with the rotating plate tilting means and configured to adjust angles of the first and second exercise bars, wherein the exercise bar tilting means comprises:

connecting rods on both sides, having one end on which a holder rotatably interference fit with an outer circumferential surface of each of the first and second exercise bars with bottom ends rotatably pin-coupled with the first brackets formed on top surfaces of the first and second rotating plates is formed and having the other end at which a pin hole is formed so as to be coupled with each of the first and second exercise bars;

a weight support including a first horizontal member hinge-coupled with one side of the base frame, a vertical member formed to be perpendicular to one end of the first horizontal member, and a second horizontal member formed at a top end of the vertical member, and in which a weight member is mounted on an end of the second horizontal member;

a tilt adjusting member formed on the vertical member and including a long hole corresponding to the pin hole of the connecting rod to adjust rotational angles of both the connecting rods; and a second stopper configured to pass through and coupled with the long hole of the tilt adjusting member and the pin hole of the connecting rod to set the rotational angles of both the connecting rods, and wherein the second stopper comprises a circular pipe, a pin coupled with a spring inserted in the circular pipe and inserted in the long hole and the pin hole, and a knob formed at an end of the pin.

6. The weight training apparatus of claim 5, further comprising a cable unit from which the second stopper is also separable according to an operation of separating the first stopper of the rotating plate tilting means, wherein the cable unit comprises an external tube body in which a wire is inserted, and wherein one end of the wire is connected to a bracket fixed to the first stopper, and the other end of the wire is connected to the pin of the second stopper.

7. The weight training apparatus of claim 1, wherein the base frame comprises a chair adjusting means configured to adjust a back-and-forth distance of the chair, wherein the chair adjusting means comprises:

a plurality of brackets attached to a side surface of the base frame;

a guide rod with both ends coupled with the plurality of brackets and horizontally mounted thereon;

a chair frame to which the chair is attached;

an operation panel on which the chair frame is mounted and with one end at which a guide holder coupled with the guide rod to horizontally slide is formed; and a fourth stopper configured to pass through and coupled with the operation panel and coupled with the plurality of adjusting holes formed in the base frame to provide a fixing force.

8. A weight training apparatus comprising:

a base frame mounted on the ground;

a chair formed above the base frame to allow an exerciser to sit thereon;

first and second exercise bars hinge-coupled with both sides of a front of the chair to be pushed forward or pulled backward by the exerciser;

a weight portion including connecting rods connected to sides of the first and second exercise bars and weight members formed on the connecting rods to provide a weight;

exercise bar rotating portions configured to adjust torsion angles by rotating the first and second exercise bars;

inclined angle adjusting means configured to adjust tilt angles of the exercise bar rotating portions in a vertical direction; and angle variation accommodating portions which accommodate variations in rotation angles and vertical angles of the first and second exercise bars and allow the connecting rods to move vertically, wherein the exercise bar rotating portions comprise:

first and second rotating plates, rotatably formed, being spaced apart from each other on both sides of a top of a support frame with both ends hinge-coupled with the base frame, and with tops at which first brackets with which the first and second exercise bars are hinge-coupled are formed;

a main circular plate formed between the first and second rotating plates, rotatably coupled with a center of a top of the support frame, and with an outer circumference on which a gear is formed;

an angle adjusting means configured to adjust a rotational angle of the main circular plate; and a first rotating force transfer means configured to transfer a rotating force between the first rotating plate and the main circular plate and a second rotating force transfer means transfer a rotating force between the second rotating plate and the main circular plate.

9. The weight training apparatus of claim 8, wherein the angle adjusting means comprises a bar connected to the main circular plate, a main stopper coupled with an end of the bar, and a horizontal angle adjusting plate formed outside the main circular plate and in which a plurality of angle adjusting holes are formed to insertion-couple the main stopper therewith.

10. The weight training apparatus of claim 9, further comprising an electrical angle adjusting portion which separates the main stopper from the angle adjusting hole using a solenoid and then sets rotational angles of the first and second rotating plates, wherein the electrical angle adjusting portion comprises:

a gear portion including a plurality of gears formed on an outer circumference of the main circular plate;

a first motor mounted on the support frame and including a pinion gear gear-engaged with the gear portion;

a fixing portion on which the first motor is mounted and slides; and an angle sensor portion configured to sense a rotational angle of the main circular plate, wherein the fixing portion comprises a support plate connected to the support frame, a moving plate mounted on a top surface of the support plate, and a vertical rod vertically formed on the moving plate, in which the first motor is mounted above the vertical rod, wherein long adjusting holes are formed in the moving plate and the support plate and a moving plate stopper coupled with the long adjusting hole to be fixed or released is included, and wherein the angle sensor portion comprises:

a plurality of contact points formed below the main circular plate and arranged in an arc shape close to the gear portion; and a sensor formed above the first motor to sense the plurality of contact points.

11. The weight training apparatus of claim 8, wherein rotation directions of a first belt and a second belt are opposite to each other to allow the first and second exercise bars to rotate in opposite directions, and wherein the first belt is formed to have an 8 shape, and the second belt is formed to have an elliptical shape.

12. The weight training apparatus of claim 8, wherein each of the first and second exercise bars comprises:

a holder including a lower rod body formed as a round rod and vertically formed while being hinge-coupled, using a shaft pin, with a connecting portion formed on a top surface of the first or second rotating plate and a bearing interference fit with a top of the lower rod body and coupled with the lower rod body to be rotated;

an upper rod body vertically insertion-coupled with a top of the holder;

a handle formed at a top end of the upper rod body; and a connecting rod coupled with the holder interference fit with the upper rod body and rotated, wherein the handle has a staple shape or a C shape including horizontal upper and lower bars and a vertical bar and includes an opening portion formed to be directed to the chair in which a middle point of the upper bar of the handle gripped by a hand coincides with a rotational axis of the upper rod body.

13. The weight training apparatus of claim 8, wherein the inclined angle adjusting portion comprises:

a connecting rod with one end hinge-coupled with the base frame, gradually inclined upward toward the other side, and including an insertion rod formed at an end to allow a circular weight plate to be fit thereon;

a support longitudinally installed on the base frame to support the other end of the connecting rod; and connecting bars formed on both sides to connect the connecting rod to the holders of the first and second exercise bars, and wherein a length of each of the both connecting bars is adjustable by insertion coupling between a first pipe with one end hinge-coupled with the holder of the first or second exercise bar and a second pipe with one end hinge-coupled with an angle variation accommodation portion and is fixed when the length has been adjusted.

14. The weight training apparatus of claim 13, further comprising a pivoting portion including an incline bar with one end connected to the support frame, formed to be inclined upward, and having the other end on which a third stopper is formed and including an angular plate formed at a top of a rear of the base frame to correspond to a rear end of the incline bar and including a plurality of angle adjusting holes formed in a longitudinal direction to be coupled with the third stopper, wherein each of the first stopper, the second stopper, and the third stopper comprises a solenoid, a circular pipe, a pin coupled with a spring inserted in the circular pipe and inserted into the angel adjusting hole, and a cable unit connected to the pin, wherein when the solenoid is operated or the cable unit is pulled, the pin escapes from a length adjusting hole, and otherwise, when the solenoid stops operating or the cable unit is released, the pin is led into and fixed to the length adjusting hole due to elasticity of the spring to enter a standby state.

15. The weight training apparatus of claim 13, wherein the angle variation accommodating portion comprises a ball formed on one side and coupled with a hinge bracket formed on the connecting rod using a shaft pin, a joint formed on one end and interference fit with the ball, and a rod formed on the other end and hinge-coupled with the connecting bar, and the angle variation accommodating portion connects the connecting rod to the connecting bar, accommodates angular variations upward, downward, leftward, and rightward, and transfers forward and backward movement of the first and second exercise bars to the connecting rod.

16. The weight training apparatus of claim 8, further comprising a vertical angle adjusting portion configured to set of an angle of an inclined angle adjusting portion, wherein the vertical angle adjusting portion comprises:

a fan-shaped gear mounted on one side surface of the support frame with both ends hinge-coupled with the base frame and with an outer circumference on which a gear is formed;

a second motor mounted on a plate coupled with the base frame and on which a pinion gear gear-engaged with the fan-shaped gear is formed; and an angle sensing portion including a plurality of contact points arranged on a side surface of the fan-shaped gear and a sensor formed on one side of the second motor to sense the plurality of contact points.

17. The weight training apparatus of claim 8, further comprising a power self-generation portion which receives vertical rotation of at least one of the connecting rods and rotates a rotor to generate power, wherein the power self-generation portion comprises:

a generator mounted in a rear of the base frame and including a pulley on a rotating shaft;

a wire rope with one end fixed to at least one of the connecting rods and wound on the pulley of the generator; and an elastic member with one end coupled with an end of the wire rope and the other end coupled with one side of the base frame to be elastically operated.

18. The weight training apparatus of claim 8, wherein a fixing clip is hinge-coupled with one side of a top surface of a bar which is connected to the main circular plate, and wherein the fixing clip performs a function of fixing a main stopper in a state in which the main stopper has been moved upward.

* * * * *